US007058335B2

(12) United States Patent
Sugiura et al.

(10) Patent No.: US 7,058,335 B2
(45) Date of Patent: Jun. 6, 2006

(54) PROCESS CARTRIDGE AND IMAGE FORMING APPARATUS WITH TONER FED CLEANING MODE

(75) Inventors: Kenji Sugiura, Yokohama (JP); Nekka Matsuura, Yokohama (JP); Yasushi Nakazato, Tokyo (JP); Takahiko Tokumasu, Tokyo (JP); Kazuhito Watanabe, Yokohama (JP); Noriyoshi Tarumi, Hachioji (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/461,399

(22) Filed: Jun. 16, 2003

(65) Prior Publication Data

US 2004/0042823 A1 Mar. 4, 2004

(30) Foreign Application Priority Data

Jun. 14, 2002 (JP) ..... 2002-174721
Jun. 5, 2003 (JP) ..... 2003-160247

(51) Int. Cl.
*G03G 15/02* (2006.01)

(52) U.S. Cl. ..... 399/100

(58) Field of Classification Search ..... 399/71, 399/99, 100, 174–176
See application file for complete search history.

(56) References Cited

U.S. PATENT DOCUMENTS 6,081,679 A * 6/2000 Yamane et al. ..... 399/71
6,295,435 B1 9/2001 Shinohara et al.
6,298,205 B1 * 10/2001 Chigono et al. ..... 399/174
6,366,751 B1 4/2002 Shakuto et al.
6,381,435 B1 4/2002 Shinohara et al.
6,434,349 B1 * 8/2002 Shimizu et al. ..... 399/100
6,449,448 B1 * 9/2002 Bessho et al. ..... 399/149
6,470,169 B1 10/2002 Nakazato
6,560,419 B1 5/2003 Sugiura
6,571,071 B1 5/2003 Kanoshima et al.
2004/0042823 A1 3/2004 Sugiura et al.

FOREIGN PATENT DOCUMENTS

JP 06-067500 3/1994
JP 10207188 A * 8/1998
JP 2000-81820 3/2000
JP 3292155 3/2002
JP 3315653 6/2002
JP 2002-328509 11/2002

OTHER PUBLICATIONS

U.S. Appl. No. 10/238,884, filed Sep. 11, 2002, Okamoto et al.
U.S. Appl. No. 09/565,545, filed May 5, 2000, Matsuura et al.
U.S. Appl. No. 09/664,832, filed Sep. 19, 2000, Yagishita et al.

(Continued)

*Primary Examiner*—Robert Beatty
(74) *Attorney, Agent, or Firm*—Oblon, Spivak, McClelland, Maier & Neustadt, P.C.

(57) ABSTRACT

A charging device of the present invention includes a charging member and a body to be charged forming a nip therebetween. Charge-promoting conductive grains, frictionally charged to polarity opposite to the polarity of a voltage applied to the charging member, are held at the above nip. The charging device is operable in a cleaning mode for cleaning the body to be charged.

28 Claims, 6 Drawing Sheets

OTHER PUBLICATIONS

U.S. Appl. No. 09/846,244, filed May 2, 2001, Shoji et al.
U.S. Appl. No. 09/962,580, filed Sep. 26, 2001, Saitoh et al.
U.S. Appl. No. 09/964,584, filed Sep. 28, 2001, Shinkai et al.
U.S. Appl. No. 09/983,687, filed Oct. 25, 2001, Seto et al.
U.S. Appl. No. 10/054,993, filed Jan. 25, 2002, Seto et al.
U.S. Appl. No. 10/107,249, filed Mar. 28, 2002, Shakuto et al.
U.S. Appl. No. 10/102,633, filed Mar. 22, 2002, Ameyama et al.
U.S. Appl. No. 10/138,633, filed May 6, 2002, Sugiura.
U.S. Appl. No. 10/143,928, filed May 14, 2002, Shakuto et al.
U.S. Appl. No. 10/155,111, filed May 28, 2002, Sano.
U.S. Appl. No. 10/253,936, filed Sep. 25, 2002, Sugiura et al.
U.S. Appl. No. 10/268,830, filed Oct. 11, 2002, Nakazato et al.
U.S. Appl. No. 10/279,903, filed Oct. 25, 2002, Takeuchi et al.
U.S. Appl. No. 10/279,901, filed Oct. 25, 2002, Takeuchi et al.
U.S. Appl. No. 10/461,399, filed Jun. 16, 2003, Sugiura et al.
U.S. Appl. No. 10/461,399, filed Jun. 16, 2003, Sugiura et al.
U.S. Appl. No. 10/686,563, filed Oct. 17, 2003, Tokumasu et al.
U.S. Appl. No. 10/461,399, filed Jun. 16, 2003, Sugiura et al.
U.S. Appl. No. 10/717,090, filed Nov. 28, 2003, Kodama et al.
U.S. Appl. No. 10/461,399, filed Jun. 16, 2003, Sugiura et al.
U.S. Appl. No. 10/769,855, filed Feb. 3, 2004, Watanabe et al.
U.S. Appl. No. 10/461,399, filed Jun. 16, 2003, Sugiura et al.
U.S. Appl. No. 10/875,277, filed Jun. 25, 2004, Shoji et al.
U.S. Appl. No. 10/461,399, filed Jun. 16, 2003, Sugiura et al.
U.S. Appl. No. 10/942,902, filed Sep. 17, 2004, Watanabe et al.
U.S. Appl. No. 10/986,781, filed Nov. 15, 2004, Matsuura et al.
U.S. Appl. No. 10/972,384, filed Oct. 26, 2004, Nakazato.
U.S. Appl. No. 11/011,193, filed Dec. 15, 2004, Nakazato et al.
U.S. Appl. No. 11/113,241, filed Apr. 25, 2005, Nakai et al.

* cited by examiner

PROCESS CARTRIDGE AND IMAGE FORMING APPARATUS WITH TONER FED CLEANING MODE

BACKGROUND OF THE INVENTION

1. Field of the Invention

The present invention relates to an image forming apparatus and a process cartridge using a contact type charging system in which a charging device charges a desired body in contact with the body, and a developer for use in the contact type charging system.

2. Description of the Background Art

In an electrophotographic image forming apparatus, a charging means for charging an image carrier, e.g., a photoconductive element to preselected potential has traditionally been implemented by a corona charging system. A corona charging system includes a wire electrode or similar discharge electrode and a shield electrode surrounding it and applies a high voltage between the discharge electrode and the shield electrode, so that the resulting corona shower charges the image carrier to preselected polarity.

Today, a contact type charging system is replacing the corona charging system because it produces a minimum of ozone and consumes a minimum of power. In a contact type charging system, a charging member is held in contact with the image carrier and applied with a preselected bias for charging the surface of the image carrier to preselected potential. This type of charging system uses a charge roller, fur brush, magnet brush, blade or similar charging member.

A contact type charging mechanism is a mixture of a discharge charging mechanism and an injection charging mechanism, as known in the art. The discharge charging mechanism charges the surface of the image carrier by using discharge to occur in a small gap between a contact type charging member and the image carrier. In this charging mechanism, a discharge start voltage necessary for discharge to start in the above gap exists, so that the charge potential of the image carrier is not proportion to the value of the bias, but proportional to the value of "bias—discharge start voltage". More specifically, the bias to be applied must be higher than the resulting charge potential. Further, the above charging system produces discharge products although smaller in amount than the corona charging system. The discharge products deposit on the image carrier and bring about various problems including the run of a latent image formed on the image carrier.

On the other hand, the injection charging mechanism causes a charging member to inject charges into the image carrier to thereby charge the surface of the image carrier. More specifically, charges are injected into a trap level present on the image carrier surface or conductive grains present in a charge injection layer or similar charge holding member. The injection charging mechanism, therefore, does not need discharge and establishes potential proportional to the bias on the image carrier. More specifically, this charging mechanism can charge, even if the voltage applied to the charging member is lower than a discharge threshold, the image carrier to potential corresponding to the voltage applied. In addition, because discharge does not occur, the problems ascribable to discharge products and including the running of a latent image are obviated.

The image carrier for use in the injection charging mechanism will be described more specifically hereinafter. The image carrier for this mechanism should preferably include a surface layer whose volumetric resistance is between $10^{10}$ Ω·cm and $10^{14}$ Ω·cm. While such an image carrier may be implemented as an amorphous silicon photoconductive element having volumetric resistance of about $10^{13}$ μ.cm, an electrophotographic photoconductive element provided with an injection layer on its surface is also preferable from the resistance adjustment standpoint. More specifically, there has been proposed to form a charge injection layer with fine conductive grains dispersed in resin on the surface of an inorganic photoconductive element or a split-function type organic photoconductive element or to disperse conductive grains in a charge transport layer for thereby causing the charge transport layer to bifunction as a charge injection layer.

As for the charge injection layer, light-transmitting resin with high ion conductivity may be mixed or polymerized with an insulative binder, or medium resistance, photoconductive resin may be used alone. It is, however, a commoner practice to form, on the outermost surface of the image carrier, a resin layer in which conductive grains implemented by a metal oxide are dispersed. In this structure, charges can be injected into the conductive grains present on the surface of the image carrier, realizing injection charging. In addition, the insulative binder obstructs the migration of charges between the conductive grains to thereby reduce the run of a latent image. Let the conductive grains contained in the surface layer and exposed on the surface of the image carrier be referred to as subject conductive grains hereinafter.

The prerequisite with the injection charging mechanism is that, to enhance injection efficiency, the charging member and image carrier desirably contact each other, i.e., the charging member surely contacts one point of the image carrier. Particularly, when the surface layer of the image carrier is formed of resin containing the subject conductive grains, injection charging is effected with the charging member and subject carrier grains contacting each other, so that the charging member must contact the exposed, subject conductive grains with high probability.

When one point of the image carrier contacts only one point of the charging member in the region where the charging member and image carrier contact each other, it is necessary that the image carrier and charging member surely contact each other for even charging. However, it is difficult for a charge roller, fur brush, magnet brush, blade or similar conventional charging member to surely contact the image carrier due to limited machining accuracy and the shave-off of the image carrier ascribable to aging.

If the charging member can contact one point of the image carrier at a plurality of points, then the probability of contact is enhanced. A typical method for implementing this configuration is providing a difference in moving speed between the image carrier and the charging member at the point of contact. However, it is difficult for a charge roller to contact the image carrier with a great speed difference because of friction to act between the roller and the image carrier. A fur brush, a magnet brush or similar contact type charging member can relatively easily contact the image carrier with a speed difference. However, although a fur brush is flexibly deformable and can desirably contact the image carrier, there arises a problem that, e.g., carrier grains released from the charging member toward the image carrier enter a developing device.

To improve electrical contact of the contact type charging member and image carrier, Japanese Patent Laid-Open Publication No. 10-307454, for example, proposes to cause conductive grains to intervene between the charging member and the image carrier, so that a speed difference can be easily established particularly when use is made of a charge roller. The conductive grains, intervening between the contact type charging member and the image carrier, will be referred to as charge-promoting conductive grains hereinafter. Functions unique to the charge-promoting conductive grains will be described hereinafter.

The charge-promoting conductive grains may be directly fed to charging means, as taught in the above Laid-Open Publication No. 10-307454, or may be fed from developing means, as taught in Japanese Patent Laid-Open Publication No. 2000-81771, or may be fed from an image transferring section, as taught in Japanese Patent Laid-Open Publication No. 2001-242686. In any case, the conductive grains are conveyed to a charging position where the image carrier and contact type charging member contact each other, and deposit on the charging member.

Even when the surface of the charging member or that of the image carrier is not uniform, the charge-promoting conductive grains thus held at the charging position fill up gaps and improve electrical connection. Further, such conductive grains play the role of a spacer that allows the charging member and image carrier to contact each other with a speed difference. In this manner, the conductive grains maintain the charging member in close contact with the image carrier, so that the charging member can desirably charge the image carrier by injection charging.

When the image carrier is chargeable to negative polarity, the charge-promoting conductive grains can electrostatically deposit on the image carrier if they are implemented by an n type semiconductor or if a p type semiconductor is contained in the surface of the image carrier. When the image carrier is chargeable to positive polarity, the conductive grains can deposit on the image carrier if they are implemented by a p type semiconductor or if an n type semiconductor is contained in the surface of the image carrier. This is presumably because friction acts between the charging member and the image carrier due to the speed difference and generates heat that causes electrons in the semiconductor to migrate, so that the conductive grains are charged to polarity opposite to the polarity of the image carrier.

Functions available with the charge-promoting conductive grains at positions other than the charging position will be described hereinafter on the assumption that the conductive grains are fed from developing means together with toner grains.

The charge-promoting conductive grains are released from the charging member to the image carrier and then transferred from the image carrier together with the toner grains at an image transfer position, so that the amount of the conductive gains at the charging means decreases little by little. It is therefore necessary to adequately replenish charge-promoting conductive grains for insuring expected injection charging for a long time. While various methods are available for replenishing the conductive grains, as stated earlier, feeding them from developing means together with toner grains, among others, is preferable because no exclusive feeding means is required.

As for replenishment from the developing means, the charge-promoting conductive grains exist in the developing means as part of a developer, which is toner in the case of a single-ingredient type developer or a toner and carrier mixture in the case of a two-ingredient type developer. When the developing means develops a latent image formed on the image carrier, the conductive grains are transferred from a developer carrier to the image carrier in an adequate amount together with toner grains. The resulting toner image is electrostatically transferred from the image carrier to a sheet or recording medium or an intermediate image transfer body at the image transfer position. At this instant, although the toner grains are easily transferred by being pulled toward the sheet or the secondary image transfer belt, the conductive grains are not done so, but are partly left on the image carrier. In a cleanerless, image forming apparatus not having a cleaning member between the image transferring means and the charging means, when image formation is repeated with the image carrier, the toner grains and conductive grains left on the image carrier after image transfer are again conveyed to the charging means by the image carrier.

The residual toner is conveyed via the charging position by the image carrier or is released from the charging member to the image carrier little by little and then brought to the developing position and collected there. The charge-promoting conductive grains left on the image carrier are also conveyed to the charging position by the image carrier and deposit on the charging member to promote injection charging. Thereafter, such conductive grains are released from the charging member to the image carrier later and then conveyed to the developing position by the image carrier. At the developing position, while the residual toner grains are easily collected by a bias electric field for development, the conductive grains are not done so because of conductivity. As a result, although part of the conductive grains is collected, the other conductive grains remain on the image carrier. In this manner, the conductive grains, remaining on the image carrier, serve as a spacer between the toner grains and the image carrier, promoting efficient image transfer at the image transfer position and enhancing efficient toner collection at the developing position.

As stated above, the charge-promoting conductive grains effectively function in each of the charging, developing and image transferring steps.

As for the charge-promoting conductive grains, some different studies on grain size have been reported in the past. Japanese Patent Laid-Open Publication Nos. 10-307454 and 2000-81766, for example, propose to use zinc oxide grains, which are an n type semiconductor, having a mean grain size of several micrometers. At the same time, the above documents describe that the charge-promoting conductive grains may be present not only in the form of primary grains but also in the form of a cohered mass of secondary grains, i.e., configuration is not important so long as the functions of the conductive grains are achievable.

Japanese Patent Laid-Open Publication No. 2001-235891, for example, studies the grain size of the charge-promoting conductive grains more specifically and teaches the following. The conductive grains exist in the form of a cohered mass of primary grains having a number-mean grain size of 50 nm to 500 nm, contain at least the cohered mass of primary grains whose grain size is 1.00 μm or above, but below 2.00 μm, and has the content of the cohered mass of primary grains whose grain size is 1.00 μm or above, but below 2.00 μm, confined in a preselected range. The above document describes that such conductive grains do not easily, firmly adhere to the surfaces of toner grains, can be fed to the image carrier in a sufficient amount during development, easily part from the surfaces of the toner grains during image transfer, can be efficiently fed to the charging position via the image carrier after image transfer, exist at the charging position in a uniformly scattered condition, and can be stably held at the charging position.

Further, Japanese Patent Laid-Open Publication No. 2001-235896 pays attention to a problem that, among the charge-promoting conductive grains, grains with extremely small grain sizes tend to firmly adhered to the surfaces of residual toner grains and lower the chargeability of the residual toner grains collected in the developing step. To solve this problem, the above document proposes to confine the amount of the conductive grains whose grain size is 0.5 m or below in a particular range.

It is to be noted that a grain size to repeatedly appear herein refers to a number-mean grain size.

However, experiments showed that when the charge-promoting conductive grains held at the nip between the image carrier and the contact type charging member were continuously used, they caused an image to run. By analyzing the surface of the image carrier after the running of an image, we found that the conductive grains formed an aggregate and adhered to the surface of the image carrier, and detected, by analyzing the conductive grains, nitric acid ions. This will be described more specifically hereinafter.

Even the injection charging mechanism causes discharge to occur, if a little, for the following reason. Because the resistance of the image carrier surface is low and because the resistance of the charge-promoting conductive grains is low, charges are induced on the image carrier surface and cause the dielectric breakdown of an air layer to occur just before the charging member and image carrier contact each other. This easily occurs in a hot, humid environment in which the resistance of the image carrier surface is apt to decrease.

Further, when an AC voltage is superposed on a DC voltage in the injection charging mechanism, the voltage sometimes rises above a discharge start voltage for a moment and causes discharge to occur. As a result, discharge products, including nitrate, are produced and accumulate on surrounding members. If a large amount of moisture is present in the air, then the discharge products react with moisture and exhibit adhesion, as known in the art. More specifically, discharge, if not noticeable, causes the discharge products to accumulate on the charge-promoting conductive grains little by little over a long time to a noticeable amount. The reaction of the products thus accumulated with moisture present in the air results in the cohesion of the conductive grains.

Moreover, the conductive grains are pressed against the image carrier surface by the charging member and therefore firmly adhere to fine dents present in the image carrier surface. Subsequently, the congregate of conductive grains on which the discharge products are deposited grows around the conductive grains so adhered to the dents of the image carrier surface. This phenomenon is generally referred to filming of charge-promoting conductive grains. Because the resistance of the conductive grains is low, an image formed in the portion where filming is present is caused to run, resulting in critically low image quality.

On the other hand, a series of extended studies and experiments showed that the fine, charge-promoting conductive grains not only lower image quality, but also reduce the life of the image carrier, as will be described specifically hereinafter.

When the charge-promoting conductive grains are implemented as a cohered mass of primary grains whose grain size is between 50 μm and 500 μm, as proposed in Laid-Open Publication No. 2001-235891 mentioned earlier, the primary grains are apt to part from the cohered mass due to agitation in the developing device, collision of the conductive grains with each other at the charging position, and friction acting between the charging member and the image carrier. Likewise, even when the grain size of the primary grains is larger than 500 μm, the conductive grains are shaved off due to the occurrences mentioned above with the result that fine powder with a grain size of 1 μm or below is produced. In these circumstances, the absolute amount of fine conductive grains around the image carrier increases little by little due to repeated image formation.

Among the fine conductive grains mentioned above, conductive grains with a grain size of 0.1 μm or below are caused to deposit on the image carrier surface by an adhering force too strong to be coped with by blade cleaning. At this instant, because van der Waals's forces are predominant over an electrostatic force, the above conductive grains adhere not only to portions around the injected conductive grains, but also to the entire image carrier surface. Consequently, a plurality of subject conductive grains are electrically connected together via the charge-promoting conductive grains.

When image formation is repeated over a long time, the image carrier surface is unevenly shaved off due to various causes including friction between the image carrier surface and the charge-promoting conductive grains and additives, and friction between the image carrier surface and carrier grains in the case of the toner and carrier mixture. As a result, the image carrier surface suffers from the maximum irregularity of about 0.6 μm in terms of surface roughness Rz although the irregularity may depend on the image forming process used. It is likely that the conductive grains enter dents so formed in the image carrier surface and therefore adhere to the image carrier even if the grain size is 0.1 μm or above. When image formation is further repeated in such a condition, the conductive grains are continuously subject to a force in the direction of movement of the image carrier at the charging position because, e.g., they contact the image carrier with a speed difference. As a result, the conductive grains are caused to move while shaving off the image carrier surface in the direction of movement of the image carrier surface. Other conductive grains easily enter the shaved portions of the image carrier surface and closely contact the conductive grains already present on the image carrier surface. In this manner, the conductive grains are continuously deposited in the direction of movement of the image carrier surface, electrically connecting the image carrier surface.

The fine, charge-promoting conductive grains thus deposited on the image carrier are not considered to immediately, adversely effect the charging step alone for the following two reasons. First, the charge-promoting conductive grains, like the subject conductive grains, are conductive and therefore do not locally increase resistance when deposited on the image carrier surface. Second, the upper limit of the charge potential at a given point of the image carrier is determined by the bias applied to the charging member and electric resistance between the point where the voltage is applied to the charging member and the image carrier surface, so that the charge potential is not susceptible to the uneven distribution of the conductive substance on the image carrier surface.

However, if the charge-promoting conductive grains deposit on the image carrier over an excessively broad range, irregular charging is apt to occur on the image carrier, depending on the conditions of the charging means. More specifically, in such a condition, a broad conductive region exists and causes the charging member to contact it with higher probability than the other portion. Therefore, if sufficient contact is not established between the subject conductive grains and charging member in the portion where the charge-promoting conductive grains are absent, then charge potential in the portion where they are present is expected to become higher than in the other portion.

The charge-promoting conductive grains additionally function to improve contact of the subject conductive grains and charging member, as stated earlier, so that the contact of the former and the latter varies in accordance with the amount of the charge-promoting conductive grains intervening between them. It is difficult to control the above amount of the charge-promoting conductive grains over a long time. When the amount of the conductive grains decreases due to a long time of operation, irregular charging occurs due to the deposition of the conductive grains, aggravating granularity of an image.

When the amount of the conductive grains decreases, as stated above, there may be executed a procedure that measures or estimates the amount of the conductive grains present with some scheme and increases, if the amount is short, the absolute value of the bias to thereby maintain the charge potential while causing fine irregular charging to evenly occur. However, when the conductive grains deposit over a broad range, only the portion where they deposit maintains expected chargeability. As a result, the above procedure causes the portion where the conductive grains deposit to be excessively charged, resulting in critical irregular charging. Should even charging be maintained to solve such a problem, the amount of the conductive grains present would have to be strictly maintained and would thereby reduce a margin as to the decrease of the conductive grains. In addition, replenishing the conductive grains in such a manner as to strictly maintain the above amount is impracticable without resorting to a highly accurate, expensive sensor.

The fine, charge-promoting conductive grains deposited on the image carrier adversely effect an image although not noticeably effecting the charging step in a short term. More specifically, assume that a boundary between the image portion and the non-image portion of a latent image is present in the portion where the conductive grains deposited over a broad range. Then, electrons are scattered from the non-image portion toward the image portion via the conductive grains deposited, blurring the contour of the latent image.

To describe the above occurrence more specifically, let one of continuous conductive regions present on the image carrier be referred to as an island-like conductive region. More specifically, island-line conductive regions each refer to a particular conductive region electrically connected on the image carrier; the conductive regions themselves are electrically isolated from each other. So long as no charge-promoting conductive grains deposit on the image carrier, the individual subject conductive grain of the image carrier forms a single island-like conductive region. However, when the charge-promoting conductive grains deposit on the image carrier, there occur not only the island-like conductive region of the individual subject conductive grain, but also an island-like conductive region where only the charge-promoting conductive grains deposited and an island-like conductive region where the charge-promoting conductive grains and more than one subject conductive grains contact each other.

To describe the blur of a latent image by using the concept of an island-like conductive region, assume that the area ratio of an image portion included in a single conductive region is A %, that the potential of the image portion is VL (V), and that the potential of a non-image portion is VB (V). Then, the potential of the entire island-like conductive region is expressed as:

$$\{VL \times A/100 + VB \times (100-A)/100\}(V)$$

A condition wherein the image and non-image portions exist together in a single island-like conductive region is rare when the conductive region is small, but often occurs as the size of the conductive region increases. Because toner grains are deposited on the image carrier during development, whether the toner grains deposit on the entire island-like conductive region or do not deposit thereon at all is dependent on the image area A mentioned above. The contour of a character image is thickened in the former case or is partly lost in the latter case. In any case, a character image has its edges disfigured while a halftone image suffers from noticeable granularity. Further, when the image area A has a certain value, the potential of the island-like conductive region is likely to substantially coincide with the bias for development and make the development of the above conductive region unstable. This also disfigures a character image or a halftone image.

As stated above, in the system using the charge-promoting conductive grains, the blur of a latent image contour occurs due to the scattering of charges via discharge products. The blur of a latent image contour is similar to the run of an image although the mechanism is entirely different. Particularly, in a hot, humid environment, the deposition of moisture further aggravates such a phenomenon, rendering the blur of the contour more conspicuous.

The charge-promoting conductive grains deposited on the image carrier cannot be easily removed at the image transferring position or the developing position, but remain on the image carrier and continuously blur latent images. A latent image is blurred when its contour is present in the island-like conductive region where the conductive grains already deposited, as stated earlier. Blur also occurs when the conductive grains concentratedly deposit on the contour of a latent image during development, thereby disturbing the contour later.

The blur of a latent image is most conspicuous when the fine powder of the charge-promoting conductive grains whose grain size is two times or more greater than the mean distance between nearby subject conductive grains deposit on the image carrier. While the mean distance between nearby subject conductive grains may be directly measured on a photograph, when uniform dispersion is assumed, the mean distance may be produced by approximation:

$$x \times (y/100)^{(1/3)} (\mu m)$$

where x denotes the mean grain size of the injected conductive grains, and y denotes a volume percent representative of the ratio of the subject conductive grains to the entire surface layer.

Why the fine powder of the conductive grains whose grain size is two times or more as great as the mean distance between the subject conductive grains aggravates the blur of a latent image is as follows. In such a condition, two or more subject conductive grains are electrically connected together with high probability and cause island-like conductive regions to join each other to form a large island-line conductive region, noticeably blurring a latent image. However, when the above mean distance is greater than 0.05 μm, it is presumably difficult for the conductive grains with the grain size two times more greater than the mean distance to adhere to the image carrier surface.

Further, the charge-promoting conductive grains deposited on the image carrier surface not only blur a latent image, but also obstruct image formation by intercepting light.

Moreover, during image transfer that electrostatically transfers toner grains, a strong electric field sometimes appear in a zone (pretransfer zone) upstream of the expected image transfer zone in the direction of movement of the image carrier. More specifically, when the potential of an island-like conductive region is closer to the potential of a non-image portion than to the expected potential of an image portion, a strong electric field sometimes appear at the prenip zone and causes toner grains to fly toward the body to be charged, causing the toner grains to be scattered to thereby aggravate granularity. The scattering of toner grains is particularly noticeable when the charge-promoting conductive grains enter the dents of the image carrier and extend island-like conductive regions in the direction of movement of the image carrier. This problem is more serious in a direct image transfer system configured to directly transfer a toner image from the image carrier to a sheet, because a stronger electric field than in the intermediate image transfer system is used in order to cope with various kinds of sheets different in electric resistance from each other.

As stated above, the fine, charge-promoting conductive grains deposited on the image carrier bring about various kinds of image deterioration. This makes it difficult for the image carrier to preserve high image quality for a long time and thereby reduces the life of the image carrier.

A jumping development system is also known in the art in which the developer carrier and image carrier face each other, but does not contact each other, and toner grains fly between them to develop a latent image. In this system, in particular, it is difficult for the charge-promoting conductive grains to move under the action of an electric field, so that much of them move toward the image carrier by being force by toner grains. Therefore, if various conditions, including the content of the conductive grains, are optimized for feeding a preselected amount of conductive grains in the developing means, then the density of the conductive grains is apt to become higher than in the contact type developing system, blurring a latent image. Another problem with jumping development is that the toner grains are apt to concentrate around the contour of a latent image, causing the conductive grains to also concentrate around the contour and blur the latent image. Such concentrated deposition is likely to thicken or omit the edges of a character image or aggravate granularity of a halftone image before image formation is repeated for a long time. In addition, the island-like conductive regions are apt to join each other and aggravate blur in a long time of operation.

The blur of a latent image ascribable to the charge-promoting conductive grains is more conspicuous when use is made of a charge roller. This is because when use is made of a magnet brush or a fur brush having an extremely large surface area, most fine powder derived from the conductive grains deposits on the brush and deposits on the image carrier little. For the same reason, the blur of a latent image occurs more in the system using the single-ingredient type developer than in the system using the two-ingredient type developer. It follows that blur is particularly noticeable in a system using a charge roller as a charging member and a one-ingredient type developer.

In a cleanerless, image forming apparatus, the charge-promoting conductive grains deposited on the image carrier are not shaved off by a cleaning blade. Therefore, the deposition of the conductive grains becomes critical in a long time. Further, in a developing device of the type superposing an AC voltage on a DC voltage for development, the toner grains and conductive grains hit against each other while moving back and forth in the narrow developing zone and therefore produce undesirable fine powder.

SUMMARY OF THE INVENTION

It is a first object of the present invention to provide a charging device capable of removing, before the filming of the charge-promoting conductive grains with discharge products deposited thereon occurs, such conductive grains from a nip without resorting to any additional member.

It is a second object of the present invention to provide an image carrier provided with a highly smooth, hard surface that prevents the cores of the charge-promoting conductive grains, which are causative of filming, from appearing.

It is a third object of the present invention to provide a process cartridge and an image forming apparatus extending the lives of structural elements.

It is a fourth object of the present invention to provide a developer, image forming apparatus and a process cartridge capable of reducing the deterioration of image quality ascribable to the blur of a latent image caused by the deposition of the fine, charge-promoting conductive grains.

It is a fifth object of the present invention to extend the life of an image carrier by obviating the deposition of the charge-promoting conductive grains over a long time.

It is a sixth object of the present invention to insure stable charging at low cost by increasing a margin as to a decrease in the amount of charge-promoting conductive grains.

In accordance with the present invention, in a charging device including a charging member and a member to be charged forming a nip therebetween at which charge-promoting conductive grains frictionally charged to polarity opposite to the polarity of a voltage applied to the charging member are held, a cleaning mode for cleaning the body to be charged is effected.

Also, in accordance with the present invention, a developer includes toner grains each containing binder resin and a colorant, conductive grains configured to intervene between a contact type charging member and an image carrier, and insulative grains configured to obstruct electrical connection between the conductive grains deposited on the image carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
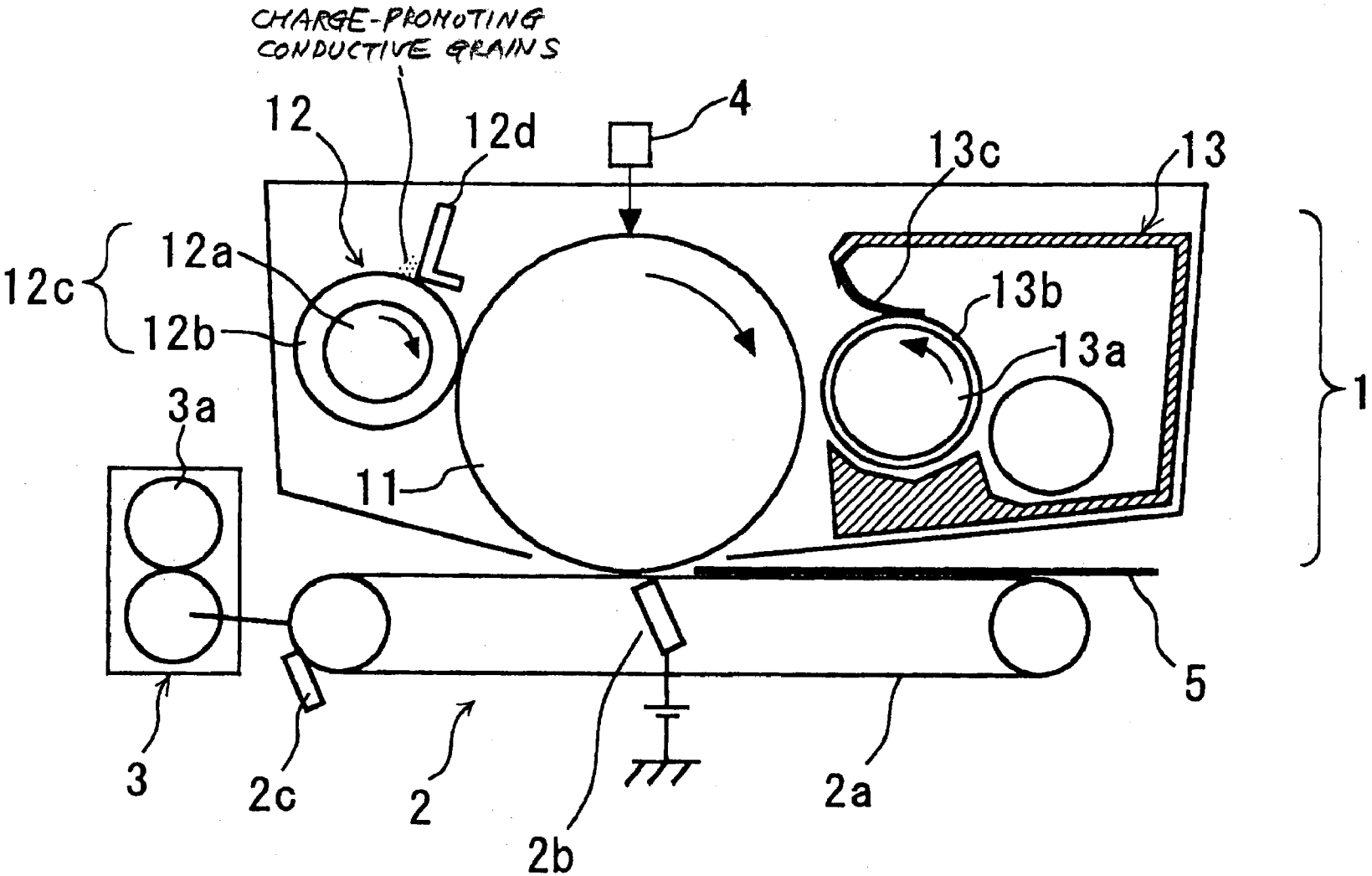
FIG. 1 is a view showing a first embodiment of the image forming apparatus of the present invention.

Referring to FIG. 1 of the drawings, an image forming apparatus embodying the present invention is shown and mainly directed toward the first to third objects stated earlier. As shown, the image forming apparatus includes a charging member 12*c* and a developing unit 13. The charging member 12*c* uniformly charges the surface of a photoconductive drum, or image carrier or a body to be charged, 11 by injection charging. The developing unit 13 is of the type collecting toner left on the drum 11 after image transfer, i.e., executing a developing/cleaning process (so-called cleanerless system).

More specifically, the drum 11 and developing unit 13 are constructed into a process cartridge 1 together with a charging device 12. The process cartridge 1 is removably mounted to the body of the image forming apparatus, allowing the user of the apparatus to easily perform maintenance including the replacement of parts. The developing unit 13 stores a developer therein and should be replaced when the developer is consumed.

An image transferring unit 2 includes an image transferring section. A bias is applied to the image transferring section to form an electric field between the image forming section and the drum 11 via a paper sheet, OHP (OverHedad Projector) film or similar recording medium (sheet hereinafter) 5, thereby transferring a toner image from the drum 11 to the sheet 5. A fixing unit 3 fixes the toner image on the sheet 5 with heat and pressure.

In the illustrative embodiment, the developer is a single-component type developer consisting of toner grains, inorganic grains, and charge-promoting conductive grains. The toner grains each contain binder resin and a colorant.

More specifically, as for the toner grains, the binder resin may be any one of styrene-based resin, styrene-based copolymer resin, polyester resin, polyvinyl chloride resin, phenol resin, natural modified phenol resin, natural resin-modified maleic acid resin, acrylic resin, metacrylic resin, polyvinyl acetate, silicone resin, polyurethane resin, polyamide resin, furan resin, epoxy resin, xylene resin, polyvinyl buthyral, terpene resin, coumarone-indene resin, and petroleum-based resin. Wax, which may advantageously be also included in the toner grains, may be selected from a group of fatty hydrocarbon waxes including low-molecular polyethylene, low-molecular polypropyrene, polyolefine and polyolefine copolymer, a group of waxes mainly consisting of fatty ester and including carnauba wax and montan acid ester wax, and deoxidated wax whose fatty ester is partly or entirely deoxidated, e.g., deoxidated carnauba wax. Preferably, 0.5 part to 20 parts by weight of wax should be contained for 100 parts by weight of binder resin.

As for the colorant, use may be made of any one or any combination of conventional dyes and pigments including carbon black, lamp black, iron black, ultramarine, nigrosine, aniline blue, phthalocyanine blue, phthalocyanine green, Hansa yellow, Hansa yellow G, rohdamine 6G, chrome yellow, quinacrydone, benzidine yellow, Rose Bengal, triarylmethane-based dyes, and monoazo and disazo pigments.

While various kinds of toner grains are usable, the toner grains for the cleaningless system should preferably be close to sphere in order to enhance image transfer ratio. Particularly, in the illustrative embodiment, the shape factor SF1 of the toner grains should preferably be 140 or below for insuring a spacer effect available with the charge-promoting conductive grains. The shape factor SF1 is expressed as:

$$SF1=(100\pi/4)\times(L^2/S)$$

where L denotes, when a toner grain is projected on a bidimensional plane, the maximum value of a line connecting two points on the circumference of the projected figure, and S denotes the area of the projected figure.

Toner grains with a minimum of irregularity in shape factor SF1 is attainable if use is made of polymerized toner. In the illustrative embodiment, use is made of toner grains produced by suspension polymerization, emulsion polymerization or similar conventional polymerization and having a weight-mean grain size of 5.0 μm.

The mean grain size of toner grains may be measured by use of a Coulter counter method, i.e., Coulter Counter TA-II (trade name) or Coulter Multisizer II (trade name) available from Beckman Coulter. For the measurement, 0.1 ml to 5 ml of surfactant, preferably alkylbenzene sulphonate, is added to 100 ml to 150 ml of electrolytic aqueous solution. The electrolytic solution refers to an about 1% NaCl aqueous solution prepared by using primary sodium chloride and may be implemented by ISOTON-II (trade name) available from Beckman Coulter. Subsequently, 2 mg to 20 mg of a sample to be measured is added to the above electrolytic solution. The electrolytic solution with the sample suspended therein is dispersed for about 1 minute to 3 minutes in an ultrasonic disperser. Thereafter, the counter mentioned above is operated to measure the volume and number of the toner grains or those of the toner with a 100 μm aperture for thereby calculating a volume distribution and a number distribution. The weight-mean grain size (D) of the toner can be produced from the above distributions.

As for the measurement, there are used thirteen different channels, i.e., 2.00 μm to below 2.52 μm, 2.52 μm to below 3.17 μm, 3.17 μm to below 4.00 μm, 4.00 μm to below 5.04 μm, 5.04 μm to below 5.35 μm, 6.35 μm to below 8.00 μm, 8.00 μm to below 10.08 μm, 10.08 μm to below 12.70 μm, 12.70 μm to below 16.00 μm, 16.00 μm to below 20.20 μm, 20.20 μm to below 25.40 μm, 25.40 μm to below 32.00 μm, and 32.00 μm to below 40.30 μm.

In the case of a two-ingredient type developer, the magnetic carrier grains should preferably have volumetric resistance of $10^{10}$ Ω·cm to $10^{14}$ Ω·cm. When injection charging is effected in the system of the illustrative embodiment, the magnetic carrier grains must have high resistance. This is because, if a magnet brush with low resistance is used for development, then charges are injected into an image carrier even in a developing zone, causing a latent image to disappear. On the other hand, should the volumetric resistance of the carrier grains be excessively high, an electric field for development would be weakened at the tips of the carrier grains and would thereby lower developing ability.

The drum or image carrier 11 will be described specifically hereinafter. In the illustrative embodiment, the drum 11 is implemented by a negatively chargeable, amorphous silicon photoconductor or provided with improved strength by the dispersion of a filler. The drum 11 is caused to rotate clockwise, as indicated by an arrow in FIG. 1, by a drive mechanism not shown. In the illustrative embodiment, the drum 11 is provided with a diameter of 24 mm and rotated such that its surface moves at a velocity of 80 mm/sec.

Figure 2:
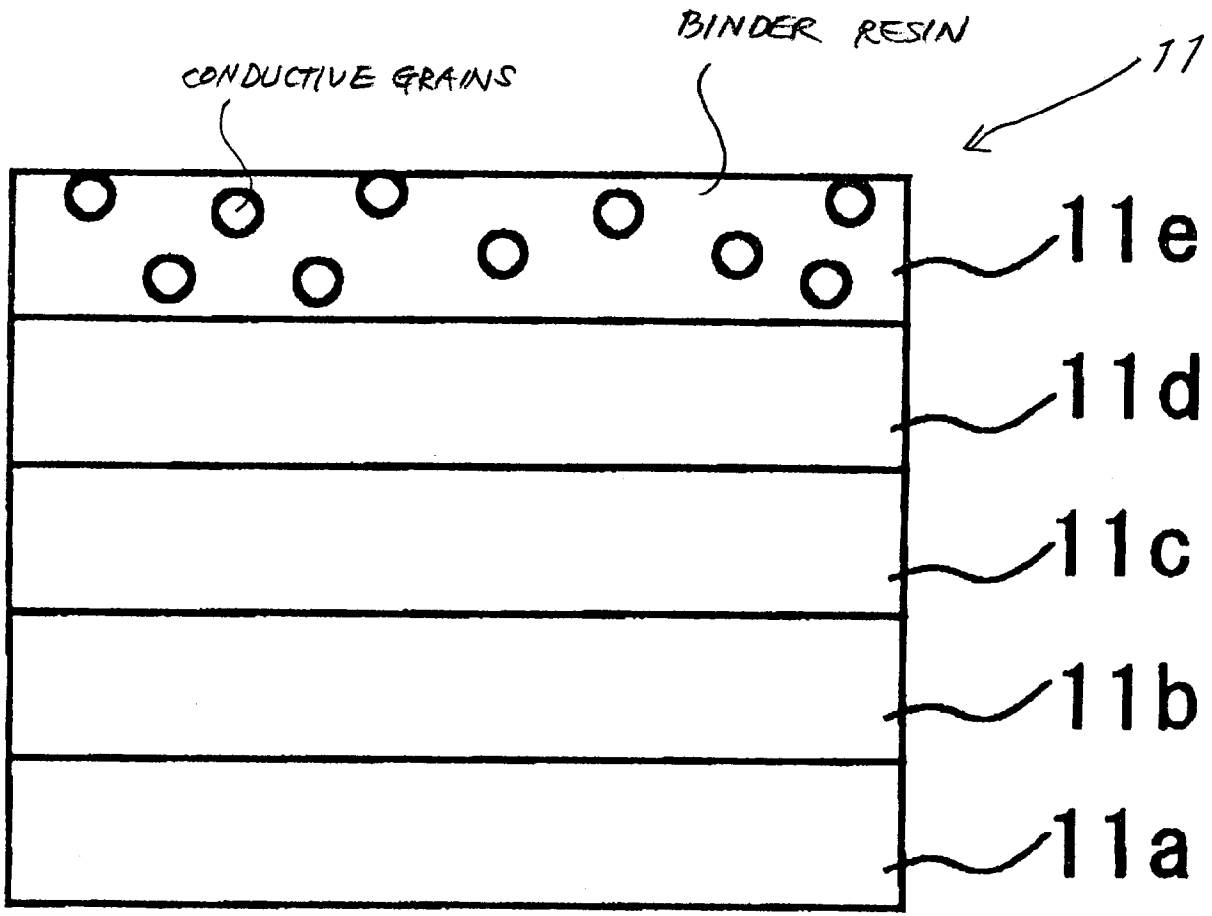
FIG. 2 is a fragmentary section showing an image carrier included in the image forming apparatus of FIG. 1.

As shown in FIG. 2, the drum 11 with a filler dispersed therein is implemented as a laminate including an aluminum base 11*a* having a diameter of 24 mm and on which an under layer 11*b*, *a* charge generating layer 11*c* and a charge transporting layer 11*d* are sequentially stacked in this order as in a conventional organic photoconductor. In the illustrative embodiment, a 3 μm thick, charge injection layer or surface layer 11*e* is additionally formed on the top of the above stack.

The charge injection layer 11*e* consists of photosetting acrylic resin and conductive tin oxide grains and tetrafluoroethylene resin grains, which have a grain size of about 0.25 μm, dispersed in the acrylic resin. More specifically, 100 mass % of about 0.03 μm, tin oxide grains lowered in resistance by antimony doped therein, 20 mass % of tetrafluoroethylene resin grains and 1.2 mass % of dispersant are dispersed in acrylic resin. Alternatively, to form the charge injection layer by dispersing conductive grains in resin, use may be made of thermoplastic resin or thermosetting resin, e.g., acrylic resin, polyester, polycarbonate, polyamide, polyurethane, polystyrene or epoxy resin. As for conductive grains, use may be made of a metal oxide or conductive carbon by way of example.

For desirable injection charging, the volumetric resistance (=volumetric resistivity) of the charge injection layer lie should preferably be $10^{10}$ Ω·cm to $10^{14}$ Ω·cm. Volumetric resistance below $10^{10}$ Ω·cm makes it difficult for a latent image to be held for a preselected period of time and thereby brings about the blur of a latent image due to the scattering of charges. On the other hand, volumetric resistance above $10^{14}$ Ω·cm obstructs desirable charge injection and thereby lower charging ability. In the illustrative embodiment, volumetric resistance of $1\times10^{12}$ Ω·cm is selected. It is to be noted that the volumetric resistance of the outermost layer of the image carrier 11 is measured by applying 100 V in a 23° C., 65% humidity environment.

In the illustrative embodiment, the charging device 12 includes the charging member 12*c* implemented as a flexible charge roller having a diameter of 12 mm. The charge roller is made up of a metallic core 12*a* having a diameter of 6 mm and a medium resistance layer 12*b* formed on the core 12*a*. For the medium resistance layer 12*b*, use is made of foam urethane consisting of urethane resin, conductive grains of carbon black, a sulfurizing agent, a blowing agent and so forth.

Other substances applicable to the medium resistance layer 12*b* include urethane, ethylene-propylene-diene polyethylene (EPDM), budadiene acrylonitrile rubber (NBR), silicone rubber or isoprene rubber in which carbon black, metal oxide or similar conductive substance is dispersed for resistance adjustment or a foam material thereof.

Major characteristics required of the charger 12 will be described hereinafter. First, the electric resistance of the charging member 12*c* should be low enough for the drum 11 to be charged. Assuming that the charging member 12*c* and charge-promoting conductive grains constitute resistance and that the subject conductive grains, which are the subject of injection, constitutes a capacitor, then the injection charging mechanism may be considered to be equivalent to an electric circuit model having the resistor and capacitor connected in series. Therefore, to charge the capacitor (=drum 11) when one point of the drum 11 is passing the charging position, the resistance of the electric circuit (=resistance of charging member and charge-promoting conductive grains) must be low. On the other hand, to obviate leak ascribable to pin holes, which may exist in the drum 11, a certain degree of electric resistance is necessary. It follows that to achieve both of sufficient charging ability and resistance to leak, the volumetric resistance should preferably be between $10^4$ Ω·cm and $10^7$ Ω·cm. To measure the volumetric resistance of the charging member 12*c*, the roller was pressed against a cylindrical, aluminum drum having a diameter of 24 mm, and then 700 V was applied between the core 12*a* and the aluminum drum.

The charge-promoting conductive grains exist at the nip between the charging member 12*c* and the drum 11. These conductive grains would obstruct close contact or lubrication if short in amount or obstruct exposure if excessive in amount. The optimum amount of the conductive grains is dependent on the grain size distribution of the grains and image forming conditions and should therefore be adequately selected in matching relation to an image forming apparatus.

The charging member 12*c* should preferably be pressed against the drum 11 by preselected pressure so as to contact the drum 11 over a preselected width in the direction of movement of the drum 11. While the width may be suitably selected in accordance with the volumetric resistance of the charging member 12*c* and the amount of the charge-promoting conductive grains, the charge-promoting conductive grains can densely contact the drum 11 if the above width is large. In this condition, the above conductive grains rub the surface of the drum 11 without any substantial gap, realizing injection charging.

Further, when the surface of the charging member 12*c* and that of the drum 11 are moved at different speeds relative to each other, the probability that the charge-promoting conductive grains contact the drum 11 increases. Particularly, when the charging member 12*c* is implemented as a roller, the above conductive grains, intervening between the drum 11 and the roller, reduce friction for thereby allowing torque between the roller and the drum 11 to be reduced. This successfully reduces an amount by which the surface of the charging member 12*c* and that of the drum 11 are shaved off due to the difference in moving speed. In the illustrative embodiment, the charging member 12*c* is rotated at a peripheral speed of 80 mm/sec (relative speed difference of 160 mm/sec) in the direction counter to the drum 11, as seen at the nip.

The present invention is practicable even when the charging member 12*c* comprises a brush implemented by conductive fibers and applied with a voltage. For such a brush, use may be made of nylon, acryl, rayon, polycarbonate, polyester or similar fibers in which conductive powder of nickel, iron, aluminum or similar conductive metal, zinc oxide, tin oxide, antimony oxide, titanium oxide or similar metal oxide or carbon black is dispersed for resistance adjustment. The brush may be either one of a fixed brush and a rotatable roller-shaped brush.

Further, the present invention is practicable even when the charging member 12*c* is implemented as a magnet brush to which a voltage is applied. A magnet brush to serve as the charging member 12*c* may be formed by positioning a nonconductive, rotatable sleeve around a stationary magnet roller such that magnetic grains are retained on the sleeve by the magnetic force of the magnet roller.

However, the illustrative embodiment is particularly effective when the charge roller is used. This is because, if use is made of a brush having a large surface area, then most of the fine, charge-promoting conductive grains deposit on the surface of the brush, reducing blur ascribable to the deposition of the conductive grains on the drum 11 to a noticeable degree.

The charging device 12 further includes a blade 12*d* playing the role of feeding/coating means for feeding and coating the charge-promoting conductive grains on the charging member 12*c*. The edge of the blade 12*d* is held in contact with the charging member 12*c*, so that the above conductive grains are held between the charging member 12*c* and the blade 12*d*. In this configuration, when the charging member 12*c* is rotated, a preselected amount of conductive grains is coated on the charging member 12*c* and conveyed to the nip or interface between the charging member 12*c* and the drum 11.

The blade 12*d* is merely a specific form of feeding/coating means and may be replaced with a foam body or a fur brush containing the charge-promoting conductive grains, which is simpler than the blade 12*d*.

The charge-promoting conductive grains (simply conductive grains hereinafter) will be described in detail hereinafter. The volumetric resistance of the conductive grains should preferably be $10^6$ Ω·cm or below so as not to lower charging ability when deposited on or mixed with the residual toner.

The charge-promoting conductive grains should preferably be transparent, white or light in color so as not to obstruct exposure. In addition, such magnetic grains should preferably have transmittance of 20% or above for light used to form a latent image.

In the illustrative embodiment, the charge-promoting conductive grains may be selected from a group of fine carbon powders including carbon black and graphite, a group of fine metal powers including copper, gold, silver, aluminum and nickel, a group of metal oxides including zinc oxide, titanium oxide, barium oxide, molybdenum oxide, iron oxide and tungsten oxide, a group of metal compounds including molybdenum sulfate, cadmium sulfate and potassium titanate and composites thereof with or without the grain size and grain size distribution being adjusted. Among them, zinc oxide, tin oxide or titanium oxide is desirable from the exposure standpoint mentioned above. Alternatively, to control resistance, use may be made of a metal oxide doped with, e.g., antimony or aluminum or fine grains having a conductive material on their surfaces may be used. For example, use may be made of fine grains of titanium oxide whose surfaces are treated with tin oxide or antimony.

The number-mean grain size of the charge-promoting conductive grains should preferably be between 1.0 μm and the mean grain size of toner grains. If the number-mean grain size is excessively small, then the grains cannot implement the expected contact at the interface, i.e., improve the chargeability of the drum 11, resulting in defective images. In addition, even if the grains are fed to the drum 11, they cannot improve the transfer of a toner image or the collection of residual toner due to the short grain size. On the other hand, if the mean-grain size is excessively large, then they cannot promote uniform charging of the drum 11 when reached the interface.

In the illustrative embodiment, the charge-promoting conductive grains are primary grains having a grain size ranging from 10 nm to 500 nm and cohered together and have a mean grain size of 3 μm.

The developing unit 13 will be described specifically hereinafter. The developing unit 13 is operable with any one of conventional developing methods including a contact and a non-contact type method, methods using a single- and a two-ingredient type developer, respectively, and methods using a magnetic and a nonmagnetic single-ingredient type developer, respectively. However, the illustrative embodiment is particularly effective when use is made of a single-ingredient type developer because in the method using a two-ingredient type developer, the fine charge-promoting conductive grains deposit on a magnet brush to thereby reduce the amount to deposit on the drum 11.

In a specific configuration of the developing unit 13, a non-contact, magnetic single-ingredient developer type of developing method is used in which a developer layer formed on a sleeve or developer carrier 13*b* has thickness smaller than the distance between the drum 11 and the sleeve 13*b*. More specifically, the sleeve 13*b*, which is nonmagnetic and has a diameter of 16 mm, accommodates a stationary magnet roller 13*a* and is rotated counterclockwise, as viewed in FIG. 1, such that its surface moves at a speed of 100 mm/sec. A developer is coated on the sleeve 13*b* while being regulated in thickness by an elastic blade 13*c*. At this instant, the developer is charged to negative polarity by friction acting between it and the blade 13*c*. In the illustrative embodiment, the distance between the sleeve 13*b* and the drum 11 should preferably be between 100 μm and 500 μm, so that a developer layer is formed on the sleeve 13*b* in an amount of 3 g/m$^2$ to 30 g/m$^2$.

Even when the charge-promoting conductive grains with low electric resistance are added to the developer, the non-contact developing method stated above prevents charge from being injected into the drum 11 via the conductive grains at the developing position. This insures an image free from fog. The non-contact type developing method is inferior to the contact type developing method as to the ability to collect residual toner. However, only if the charge-promoting conductive grains are implemented as a cohered mass of primary grains having an adequate grain size distribution, then the conductive grains, which easily part from toner grains, exist on the drum 11 and enhance the collection efficiency of residual toner to the developing device 13 even with the non-contact type developing method.

Not only a DC electric field but also an AC electric field are formed between the sleeve 13*b* and the drum 11. An AC voltage may have any suitable waveform, e.g., a sinusoidal, a rectangular or a trianglular waveform. Alternatively, the AC voltage may be implemented as a pulse wave produced by periodically turning on and turning off a DC power supply.

The AC electric field formed between the sleeve 13*b* and the drum 11 should preferably implemented by a voltage of 500 Vpp (peak-to-peak) to 3,500 Vpp and a frequency of 300 Hz to 5,000 Hz. Such an AC electric field allows the charge-promoting conductive grains added to the developer to easily, evenly move toward the drum 11 for thereby enhancing contact between the charging member 12*c* and the drum 11 via the conductive grains and therefore promoting uniform injection charging of the drum 11. If the frequency or the peak-to-peak voltage is excessively high, then charges are apt to migrate away from the injection site on the drum 11 to the conductive grains, blurring an image.

The optical writing unit 4 optically scans the charged surface of the drum 11 in accordance with image data for thereby forming a latent image on the drum 11. The writing unit 4 may a semiconductor laser or an LED array as a light source by way of example.

The image transferring device 2 includes a belt 2*a* for conveying the sheet 5 and a charge blade 2*b*. For the belt 2*a*, use is made of a belt formed of 25 μm to 2,000 μm thick polyimide resin in which carbon black, zinc oxide, tin oxide or similar conduction agent is dispersed to establish medium resistance (volumetric resistance) of $1\times10^7$ Ω·cm to $1\times10^{10}$ Ω·cm. The charge blade 2*b* is formed of polyurethane rubber, EPDM or similar elastic material in which carbon black, zinc oxide, tin oxide or similar conduction agent is dispersed to establish medium volume resistance of $1\times10^6$ Ω·cm to $1\times10^{10}$ Ω·cm.

The image transferring device 2 is held in contact with the drum 11 via the sheet 5, which is being conveyed by the belt 2*a*, so that a toner image is electrostatically transferred from the drum 11 to the sheet 5. It is a common practice with such a direct contact type of image transferring method to apply a relatively high voltage for image transfer, so that a sufficient electric field can be formed while coping with sheets having various volumetric resistance values. This, however, gives rise to a problem that in the condition wherein regions where the charge-promoting conductive grains are deposited exist like islands inside and outside of the image transferring position, the relatively high voltage is apt to act even on a prenip portion for image transfer and cause the toner grains to fly onto the sheet 5.

A cleaning blade 2*c* is formed of polyurethane rubber and used to clean the surface of the belt 2*a*. The cleaning blade 2*c* removes paper dust and toner deposited on the surface of the belt 2*a* for thereby enhancing the conveying ability of the belt 2*a*. At the same time, the cleaning blade 2*c* insures close contact of the sheet 5 and drum 11. Further, the cleaning blade 2*c* removes the charge-promoting conductive grains brought thereto from the drum 11 via the belt 2*a* in a cleaning mode unique to the illustrative embodiment, as will be described later specifically.

More specifically, while the charge-promoting conductive grains with discharge products deposited thereon show far lower electric resistance than toner grains, the chargeability of toner grains on which such conductive grains are deposited in a large amount differs from usual chargeability. A developer with which the above toner grains are mixed cannot effect expected development because the amount of charge is shifted from a target amount. In light of this, the cleaning blade 2*c* collects the toner grains on which the conductive grains with the charge products are deposited, thereby preventing such toner grains from being returned to the developing unit 13.

While the fixing unit 3 may have any one of conventional configurations, it includes a heat roller 3*a* and a press roller 3*b* in the illustrative embodiment. The heat roller 3*a* and press roller 3*b* fix a toner image on the sheet 5 with heat and pressure while conveying the sheet 5.

The operation of the image forming apparatus having the above configuration will be described hereinafter. The apparatus is selectively operable in a copier mode or a printer mode. In a copier mode, image information read from a document by a scanner is converted to image data by way of various kinds of image processing including analog-to-digital conversion, MTF correction, and tonality processing. In a printer mode, image processing is executed with image information received from, e.g., a computer to thereby output image data.

Before image formation, the drum 11 is caused to start rotating clockwise, as viewed in FIG. 1, such that its surface moves at a speed of 80 mm/sec. Also, the charging member 12*c* is caused to rotate at the peripheral speed of 80 mm/sec in the direction counter to the drum 11. At this instant, a DC voltage of −700 V is applied from a power supply, not shown, to the core of the charging member 12*c*, causing the charging member 12*c* to uniformly charge the surface of the drum 11. In this condition, the charge-promoting conductive grains serve as a spacer for establishing a speed difference between the charging member 12*c* and the drum 11, rubbing the surface of the drum 11 without any gap at the nip. As a result, the drum 11 is uniformly charged by the injection charging mechanism stated previously.

The writing unit 4 scans the charged surface of the drum 11 with light in accordance with the image data to thereby form a latent image represented by a difference in potential between an illuminated portion and a non-illuminated portion. The developing unit 13 develops the latent image with the single-ingredient type developer, i.e., toner for thereby producing a corresponding toner image. At this instant, the charge-promoting conductive grains contained in the developer move toward the drum 11 together with or by being forced by the toner grains.

The surface of the drum 11 is deteriorated little by little due to repeated image formation, so that fine irregularity appears on the drum 11. As a result, the charge-promoting conductive grains are pressed against the drum 11 at the charging position and image transfer position and are further urged toward the drum 11 at the charging position due to collision with each other. Consequently, the conductive grains are buried in dents formed in the drum 11. Although the illustrative embodiment causes the developing unit 13 to collect the residual toner, the above phenomenon is more conspicuous in an image forming apparatus using a cleaning blade.

The fine conductive grains thus buried in the dents of the drum 11 firmly adhere to the surface of the drum 11. Further, because the force, urging the conductive grains toward the drum 11, continuously acts on the buried conductive grains, the conductive grains scratch the surface of the drum 11 deep and long to the downstream side in the direction of the movement of the drum 11. When the other conductive grains and inorganic grains, which are insulative, are deposited on or buried in the resulting scratches, portions where a large amount of fine grains are deposited are produced on the drum 11. While if such an amount of fine grains all are conductive, then they blur a latent image, the developer of the illustrative embodiment contains an adequate amount of insulative grains and causes them to obstruct mutual electric connection of the charge-promoting conductive grains for thereby obviating blur.

It is to be noted that if the fine grains have a grain size of less than 1 nm, then insulation is not achievable because charges migrate due to the tunnel effect although such fine grains may intervene between conductive grains. In light of this, the charge-promoting conductive grains and insulative grains should only be provided with a grain size of 1 nm or above each.

Figure 3:
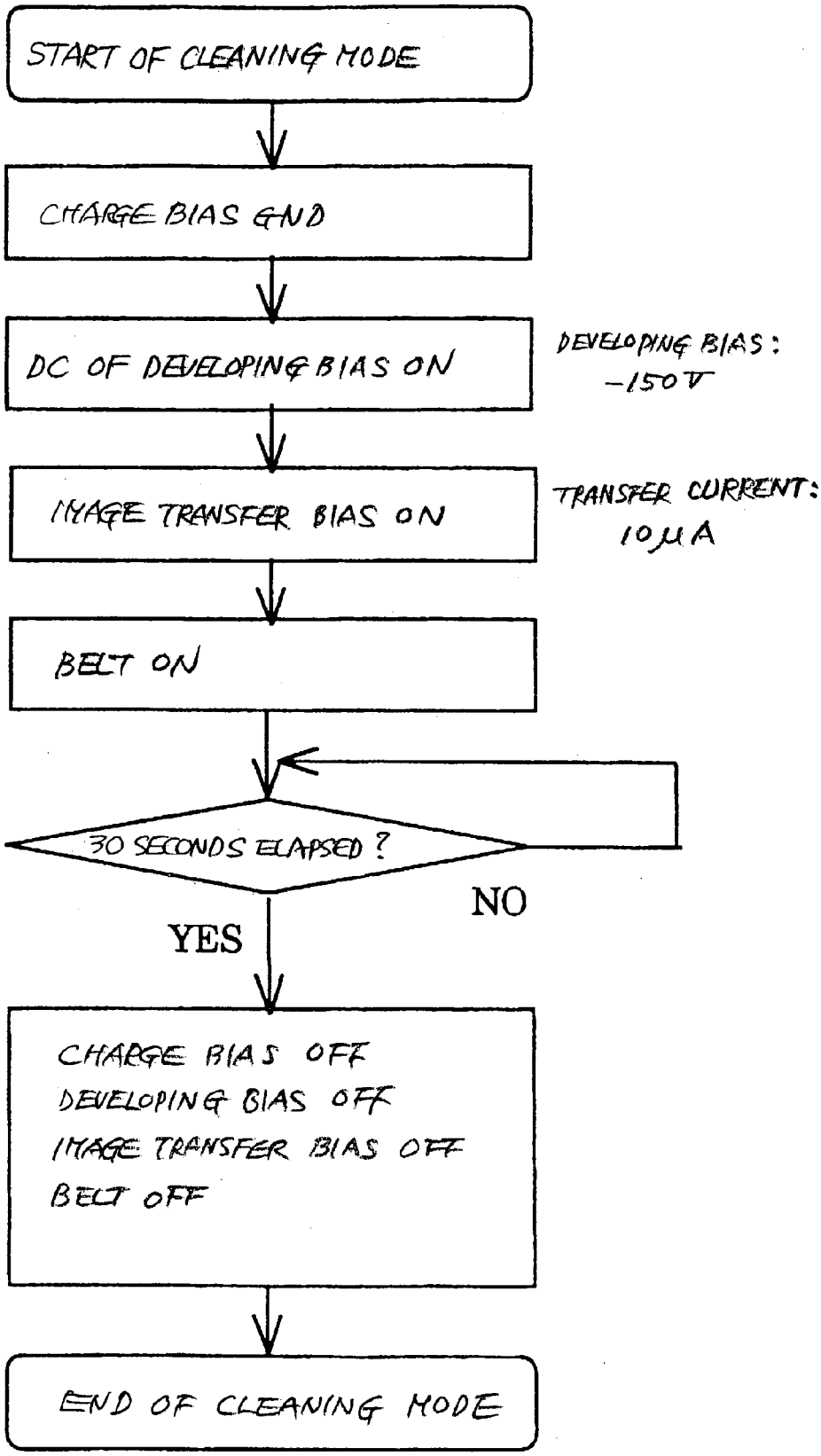
FIG. 3 is a flowchart demonstrating a cleaning mode unique to the illustrative embodiment.

Now, the cleaning mode unique to the illustrative embodiment will be described with reference to FIG. 3 hereinafter. Briefly, the cleaning mode is executed in accordance with the condition of the apparatus sensed beforehand so as to remove the charge-promoting conductive grains with discharge products deposited thereon from the drum 11. The condition to be sensed is the cumulative number of prints produced, the number of rotations of the drum 11 or a period of time elapsed since the turn-on of a power switch or a combination thereof. In the following description, assume that transition to the cleaning mode occurs on the basis of the cumulative number of prints produced by way of example, and that the reference cumulative number of prints is 200.

A controller, not shown, records the number of prints produced in an exclusive memory assigned to the cleaning mode. When the number of prints reaches 200, the controller executes the cleaning mode by determining that the content of the memory has satisfied the preselected condition. On the completion of the cleaning mode, the controller resets the memory. More specifically, as shown in FIG. 3, on the start of the cleaning mode, the charging member 12*c* is grounded while the bias for the developing device 13 is turned on, feeding toner to the drum 11. Subsequently, the toner is transferred to the belt 2*a* and then collected by the cleaning blade 2*c*. The duration of cleaning mode operation may be suitably selected in accordance with, e.g., the diameters of structural elements.

By periodically executing the cleaning mode stated above, it is possible to remove the charge-promoting conductive grains before filming occurs on the drum 11 and therefore to obviate the run of an image and other image defects.

Experiments conducted in relation to the illustrative embodiment will be described hereinafter.

[Experiment 1]

In Experiment 1, while the apparatus of FIG. 1 and the drum 11 of FIG. 2 were used, the charge-promoting conductive grains between the charging member 12*c* and the drum 11 were not replaced. The apparatus for experiment was situated in a 30° C., 90% humidity environment or hot, humid environment, allowing discharge products to easily react with moisture contained in air. In this condition, the apparatus was operated to output 50,000 prints by use of plain paper sheets. The charge-promoting conductive grains were allowed to be fed from the charging member 12*c*. The biases for charging and development were −700 V and −450 V, respectively, while the charge potential on the surface of the drum 11 was between 660 V and 680 V.

An image was found to start slightly running on the 20,000th print or so, as observed by eye, and to run over the entire surface on the 30,000th print or so. An image was entirely lost on the 35,000th print, so that the experiment was ended.

After the experiment, the surface of the drum 11 was found to be irregular more than before the experiment, and the charge-promoting conductive grains firmly adhered to the drum 11. Moreover, as a result of chemical analysis of the conductive grains adhered to the drum 11, ammonium nitrate originally absent was detected. This suggests that the conductive grains adhered to the drum 11 formed a low-resistance region on the drum 11 and prevented a latent image from being preserved.

[Experiment 2]

Experiment 2 was identical with Experiment 1 except for the following. To confirm the refreshing effect of the charge-promoting conductive grains, every time 500 prints were output, the conductive grains at the nip were wiped off by cloth. Because the conductive grains were consumed more than in Experiment 1, fresh conductive grains were suitably replenished In the above condition, images did not run even after 50,000 prints were output. The conductive grains, of course, did not adhered to the drum 11 after the experiments. More specifically, because the conductive grains did not adhere to the drum 11, the low-resistance region was not formed, and therefore a latent image was not disturbed.

[Experiment 3]

To find the optimum condition for removing the charge-promoting conductive grains from the nip, the voltage applied to the charging member 12*c* was varied so as to observe the resulting behavior of the conductive grains at the nip. More specifically, voltages of −100 V, 0 V and +100 V were applied to the charging member 12*c*. In this condition, the apparatus was driven for 30 seconds to see how the conductive grains at the nip vary. In this case, the conductive grains are not fed from the charging member 12*c*. Further, the developing device 13 was dismounted to isolate the influence of the toner grains.

Experiment 3 showed that although the amount of the conductive grains at the nip did not vary for the voltages of −100 V and +100 V, the conductive grains disappeared from the nip when the voltage was 0 V, i.e., the charging member 12*c* was grounded. This is presumably because no forces for retaining the conductive grains act due to the absence of an electric field at the nip.

[Experiment 4]

Experiment 4 pertains to a method of cleaning the charge-promoting conductive grains. In Experiment 3, the charge-promoting conductive grains flown away from the nip deposit on the drum 1 and cannot be removed by a fur brush or a blade because their grain size is small. In light of this, in Experiment 4, the charging member 12*c* was grounded as in Experiment 3, so that no conductive grains were fed from the charging member 12*c*. While a voltage of +50 V was applied to the developing device 13 to allow some toner to be fed to the drum 11, the drum 11 was caused to rotate. Also, the belt 2*a* was held in contact with the drum 11 without the intermediary of the sheet 5 and then driven, so that the toner was transferred from the drum 11 to the belt 2*a* and then removed by the cleaning blade 2*c*.

After the above experiment, no conductive grains were found on the drum 11. This is presumably because the conductive grains deposited on the toner fed from the developing device 13 and then transferred to the belt 2*a* together with the toner. By contrast, the conductive grains remained on the drum 11 when toner was not fed from the developing device 13.

As stated above, the illustrative embodiment achieves various unprecedented advantages, as enumerated below.

(1) The charge-promoting conductive grains on which discharge products are deposited are periodically removed from the nip. This frees the charging device from the filming of the conductive grains.

(2) The toner fed to the entire surface of the member to be charged removes the conductive grains with discharge products deposited thereon, thereby freeing the drum from the filming of the conductive grains.

(3) The member to be charged is implemented as an amorphous silicon photoconductive element desirable in smoothness or a photoconductive element increased in hardness by a filler disposed in its surface layer. The member to be charged, therefore, does not allow the cores of filming of the conductive grains to easily appear.

(4) By using the above charging device and member to be charged, it is possible to implement an image forming apparatus free from the deterioration of image quality, including the running of an image, for a long time.

(5) There can be implemented an image forming apparatus capable of performing expected development despite that the member to be charged is cleaned.

(6) Polymerized toner has stable chargeability and therefore realizes an image forming apparatus capable of surely removing the conductive grains on which discharge products are deposited.

(7) A long-life process cartridge is achievable that is free from defective images.

An alternative embodiment of the present invention, mainly directed toward the fourth to sixth objects stated earlier, will be described with reference to FIG. 4. Because this embodiment is substantially identical with the previous embodiment as to the configuration and operation of the drum 11, charging device 12, developing unit 13, writing unit 3 and fixing unit 3, the following description will concentrate on differences between the two embodiments.

Figure 4:
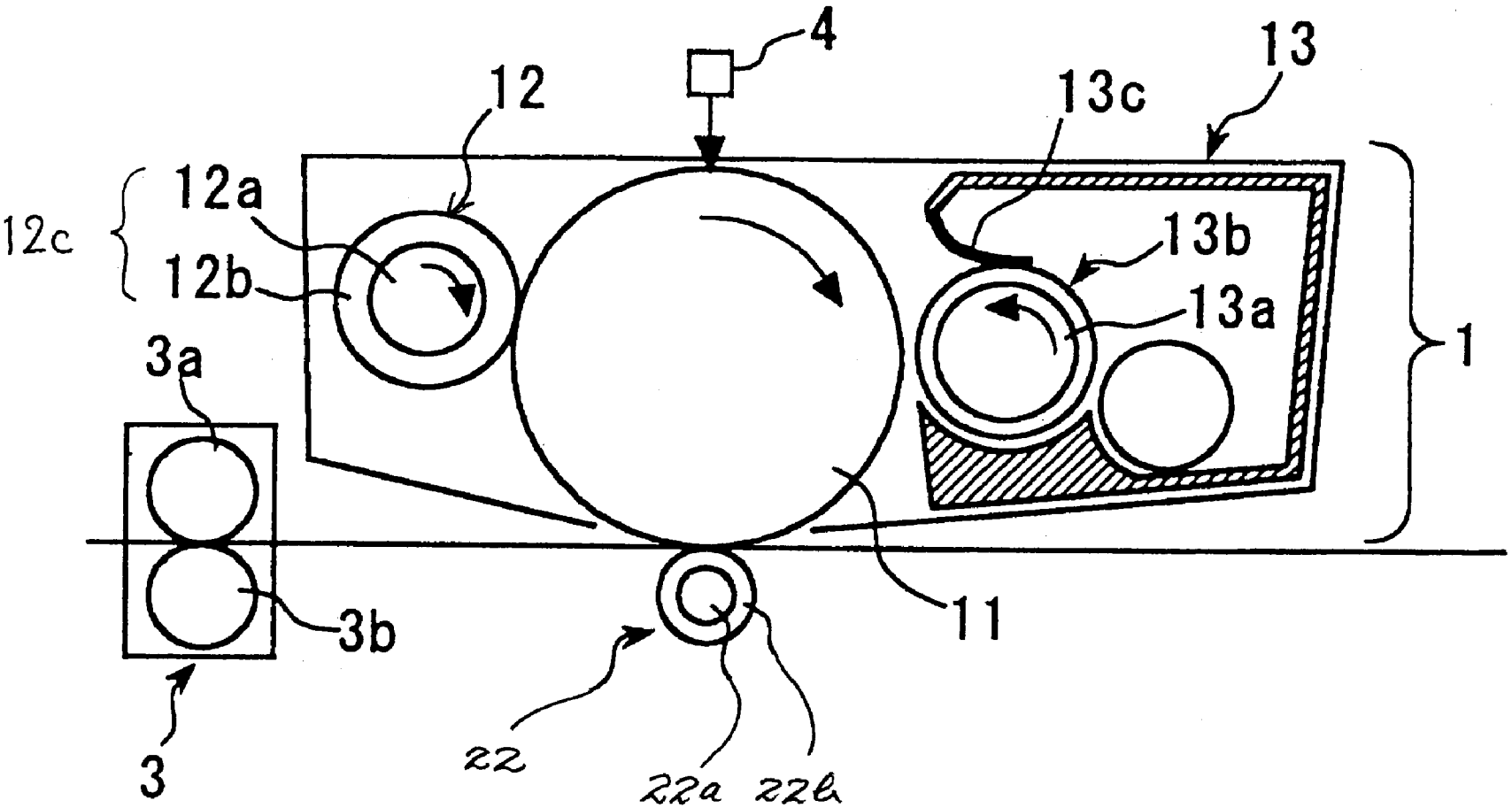
FIG. 4 shows an alternative embodiment of the present invention.

As shown in FIG. 4, in the illustrative embodiment, an image transferring device 22 is implemented as a roller including at least a metallic core 22*a* and a conductive elastic layer 22*b* formed on the core 22*a*. The conductive elastic layer 22*b* is formed of polyurethane rubber, EPDM or similar elastic material in which carbon black, zinc oxide, tin oxide or similar conduction agent is dispersed for resistance control. In the illustrative embodiment, the conductive elastic layer is provided with medium resistance of $10^6$ Ω·cm to $10^{10}$ Ω·cm.

In the illustrative embodiment, too, a toner image is transferred from the drum 11 to the sheet with the image transferring device 22 being held in contact with the drum 11. It is a common practice with such a direct contact type of image transferring method to apply a relatively high voltage for image transfer, so that a sufficient electric field can be formed while coping with sheets having various volumetric resistance values, as stated earlier. This, however, gives rise to a problem that in the condition wherein regions where the charge-promoting conductive grains are deposited exist like islands inside and outside of the image transferring position, the relatively high voltage is apt to act even on a prenip portion for image transfer and cause the toner grains to fly onto the sheet 5.

The illustrative embodiment therefore is particularly effective when applied to an image forming apparatus of the type causing the drum or image carrier 11 to directly contact the sheet.

The charge-promoting conductive grains used in the illustrative embodiment will be described hereinafter. The conductive grains refer to grains having such a degree of electric resistance that injection charging can be effected at the charging position. The resistance is dependent on the voltage to be applied to the charging position. For example, assuming a voltage of several hundred voltages usually applied to a charging member, the conductive grains may be regarded as grains whose volumetric resistance is $10^6$ Ω·cm or below.

In the illustrative embodiment, the developer further contains insulative grains generally used to improve the fluidity of a developer and uniform the frictional charging the toner grains. Therefore, with the insulative grains, it is possible to enhance the transfer of toner grains, to reduce the amount of residual toner grains to deposit on a contact type charging member, to prevent the chargeability of an image carrier from falling, and reduce load necessary for the collection of residual toner in the developing step.

When the primary grains of the inorganic grains have an excessively large number-mean grain size, they lower the fluidity of toner grains and make it difficult to uniformly deposit the charge-promoting conductive grains on toner grains in a developer. As a result, the feed of the conductive grains to the image carrier is apt to become irregular, resulting in defective charging. Further, a decrease in fluidity is apt to make the frictional charging of toner grains uneven and therefore bring about fog and other problems. Conversely, when the number-mean grain size of the primary grains is excessively small, the inorganic fine powder is apt to cohere and therefore cannot implement the uniform charging of toner grains or the uniform scattering of the conductive grains in the developer. In this respect, the number-mean grain size of the primary grains of the inorganic grains should preferably be between 10 nm and 50 nm.

In the illustrative embodiment, the insulative grains should preferably contain at least one of silica, titania and alumina. Also, the insulative grains should be hydrophobic in order to prevent chargeability from being lowered in a humid environment.

The insulative grains refer to grains having such electric resistance that, when the grains are deposited on the surface of an image carrier, the distance by which charge moves due to a potential difference between an image portion and a non-image portion within a period of time necessary for one point of the image carrier to move from a developing position to an image transfer position. More specifically, assuming a usual potential difference of 1,000 V or below between an image portion and a non-image portion, the insulative grains are required to have volumetric resistance of $10^8$ Ω·cm or above.

More preferably, the volumetric resistance of insulative grains should be $10^{10}$ Ω·cm or above for the following reason. A charge injection layer included in a charge injection type of image carrier should preferably be $10^{10}$ Ω·cm or above in order to obviate charge scattering, as generally accepted. Therefore, if the volumetric resistance of the insulative grains is $10^{10}$ Ω·cm or above, then charge scattering can be obviated even when the insulative grains deposit over the entire surface of the image carrier.

To measure volumetric resistance, a cell for measurement is prepared in which a pair of tubular electrodes each having a diameter of 2 cm are positioned face to face at a distance of 2 mm. After grains to be measured have been filled in the cell, the two electrodes are caused to nip the grains therebetween such that load of 1 kg acts on the grains. Subsequently a voltage of 100 V is applied between the electrodes so as to measure the resulting current with an ammeter.

As for the grain size, we experimentally found that, among the charge-promoting conductive grains, grains with an extremely small grain size degraded image quality. More specifically, the conductive grains originally exhibit various unique functions only when parted from toner grains, so that the parting ratio must be increased by controlling, e.g., the grain size of the primary grains and cohesion. However, such grains parted from toner grains repeatedly hit against each other and against the drum 11 without being buffered by the toner resin and are therefore apt to become fine powder in the event of image formation. The resulting extremely fine grains are apt to firmly adhere to the drum 11 presumably because the van der Waals' s forces act more strongly on such extremely fine grains and because irregularity of the order of submicrons exists on the surface of the drum 11.

The relation between the grain size and the adhesion to the drum 11 is dependent on the material of the drum 11 and cleaning conditions. Generally, grains with a grain size of less than 0.1 μm deposited on the drum 11 are difficult to remove and remain on the drum 11 due to strong van der Waals's forces. This is also true with the charge-promoting conductive grains.

When a conductive substance deposits on an image carrier, it is likely that injection sites on the surface of the image carrier and conductive substance contact each other. The injection sites refer to positions where charges are injected from the charging member into the image carrier, e.g., refer to the subject conductive grains of the image carrier. When the injection sites and conductive substance contact each other, the charges are scattered or the charges at the injection sites migrate into the conductive substance due to an electric field formed at, e.g., a developing position.

A fine conductive substance contacts the injection sites on the image carrier more easily than a large conductive substance. This is because grains with a large size cohere themselves and therefore contact the image carrier only over a small area and because such grains occupy a substantial space and obstruct the deposition of the other grains therearound. It follows that extremely fine charge-promoting conductive grains allow charges at the injection sites to migrate into the conductive substance more easily, resulting in the blur of a latent image.

The deposition of the charge-promoting conductive grains whose size is less than 0.1 μm stated above is apt to locally occur at the developing position, among others. More specifically, during development, the charge-promoting conductive grains do not easily move when subject to an electric field, but mostly move toward the image carrier by being forced by toner grains. Consequently, the conductive grains are apt to densely gather around an image portion and deposit on the image carrier in a large amount. This is particularly true with jumping development used in the illustrative embodiment. To prevent a latent image of the type being disturbed by concentrated deposition during development from being blurred, some measure must be taken in the developing step.

A series of extended researches and experiments showed that the problem stated above could be solved when, for grain sizes of less than 0.1 μm, the content of insulative grains and the content of the charge-promoting conductive grains, which are parted in the developer, were adjusted relative to each other. More specifically, we found that assuming that, among the insulative grains contained in the developer, the number of grains having a grain size of r (smaller than 0.1) was n(r), and that, among the charge-promoting conductive grains also included in the developer, the number of grains having the size r was 2(*r*), then the blur of a latent image could be obviated under the following condition:

$$\Sigma r^2 \times n1(r)/\Sigma r^2 \times n2(r) > 2.0$$

where Σ denotes summation relating to the grain size r.

In the above relation, $r^2 \times n\mathbf{1}(r)$ is a value proportional to a total projection area to appear when, among the insulative grains present in the developer, grains with the size r all are projected on a bidimensional plane without overlapping each other. Likewise, $r^2 \times n\mathbf{2}(r)$ is a value proportional to a total projection area to appear when, among the charge-promoting conductive grains present in the developer, grains with the size r all are projected on a bidimensional plane without overlapping each other.

More specifically, the crux of the illustrative embodiment is that when the charge-promoting conductive grains deposited on the image carrier form a wide conductive region during development, the insulative grains similar in size to the conductive grains are caused to deposit on the image carrier to thereby obstruct mutual contact of the conductive grains, i.e., to prevent the above conductive region from growing.

The fine powder of the charge-promoting conductive grains appears as image formation is repeated. Therefore, the grain size distribution of the charge-promoting conductive grains and that of the insulative grains must be adjusted not only at the initial stage, but also during image formation. The surest way to implement such adjustment is to replenish the insulative grains matching in size distribution and amount to the conductive grains fed. While the insulative grains may be replenished independently of the conductive grains, it is more reliable and simpler to prepare a mixture of insulative grains and conductive grains and replenish the mixture. The illustrative embodiment is assumed to replenish such a mixture.

The higher the ratio of, among the grains with sizes of less than 0.1 μm to the entire developer, the insulative grains, the surer the obstruction of electric connection stated above. In practice, however, it is difficult to control fine grains or ultra-fine grains such that the ratio of the insulative grains to the entire developer is, e.g., 99%. The problem is, therefore, the degree to which the ratio of the insulative grains should be increased.

To estimate an adequate ratio, assume an extreme case wherein the entire surface of the image carrier is covered with the fine powder of the charge-promoting conductive grains and that of the insulative grains. Even in such an extreme condition, if a condition that prevents the island-like conductive regions from limitlessly growing is established, then blur can be prevented from extending over a broad range.

Assuming that, among the fine powders covering the entire surface of the image carrier, the fine powder of the conductive grains has an area ratio of p ($0<p<1$), then the area ratio of the fine powder of the insulative grains is (1−p). The island-like conductive region critically extends if p is large or remains in a limited portion if p is small. To determine the size of the island-like conductive region that varies in accordance with p, use may be made of the percolation theory belonging to a family of probability theorem in the mathematics field.

Figure 5:
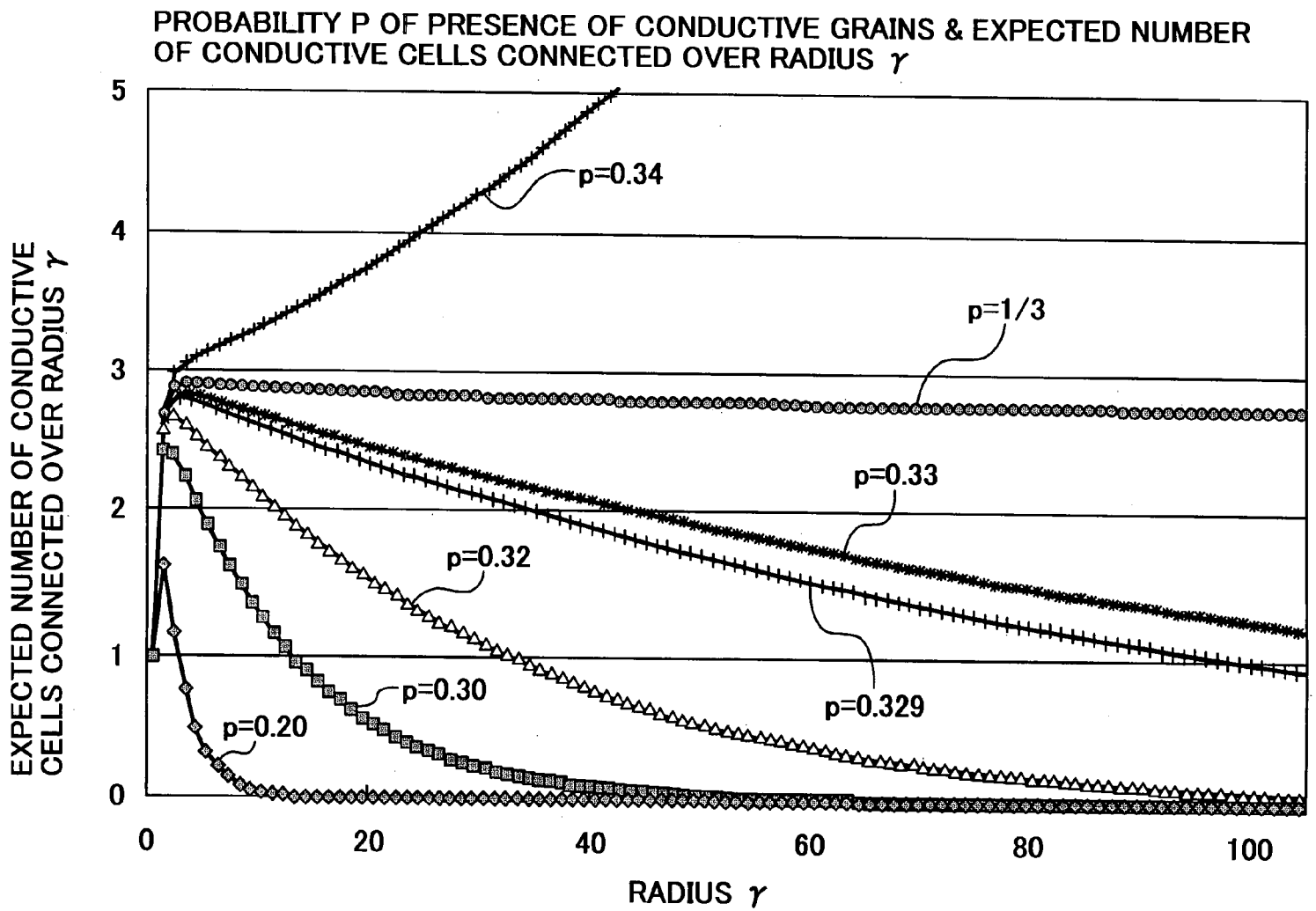
FIG. 5 is a graph showing the probability p of presence of conductive grains in a developer and the expected value of the number of conductive cells electrically interconnected over a radius of r.

Assume a model in which, among cells arranged bidimensionally, each cell is made conductive with the probability p. FIG. 5 shows a relation between, in the above model, the distance or radius r from a single center cell and, among the cells positioned at the distance r, the expected number of conductive cells electrically connected together from the center cell. For calculation, the center cell is assumed to be conductive without fail. As for electric connection, if one of cells (i,j+1) and (i,j−1) vertically adjoining a conductive cell (i,j) or one of cells or cells (i+1,j) and (i−1,j) horizontally adjoining the same or one of cells (i+1,j+1), (i−1,j−1), (i+1,j−1) and (i+1,j−1) obliquely adjoining the same is conductive, then the cell is considered to be electrically connected. As for the distance r, it is assumed that r is 0 at the center cell and that r sequentially increases from 1, 2, 3 and so forth at eight cells adjoining the center cell and successive cells. The distance r is therefore representative of the minimum number of transitions to a target cell.

In FIG. 5, the ordinate indicates the distance r while the abscissa indicates the expected value of the number of conductive cells, i.e., the number of cells located over the distance r and electrically connected to the center cell. Therefore, the radius r smaller than 1 on the ordinate is the distance where electrical connection to the center cell is expected. However, because the center cell at the distance r of 0 is assumed to be conducive, value on the ordinate is 1 at any probability p. This is dealt with as a singular point and excluded from decision on electrical connection.

As FIG. 5 indicates, whether or not electrical connection exists is noticeably different at both sides of p=⅓. More specifically, when p exceeds ⅓, the expected value of the number of conductive cells increases in accordance with r, extending electrical connection. On the other hand, when p is less than ⅓, the expected number of conductive cells attenuates in accordance with the increase or r, confining electrical connection in a limited area.

When a conductive substance is generated with the probability p in a bidimensional plane, the probability p that the conductive region extends over a preselected area is dependent on a model used for calculation. In the specific extreme case concerned, the conductive region is apt to extremely extend because of the previously stated condition. In practice, therefore, the probability p may have a larger value. This, coupled with the fact that the above model takes account not only of cell connection in the horizontal and vertical directions but in the oblique directions, indicates that if the probability p is at least smaller than ⅓, then the island-like conductive region can be confined in a limited area.

The value p is representative of the area ratio of the conductive region where the fine conductive powder is deposited to the entire surface S of the image carrier, so that there holds:

$$p=\{\Sigma r^2\times n2(r)/S\}<1/3$$

Further, in the specific condition wherein the fine powder of the conductive grains and that of the insulative grains cover the entire surface of the image carrier, there holds:

$$\{\Sigma r^2\times n1(r)+\Sigma r^2\times n2(r)=S$$

Therefore $$(1-p)=\{\Sigma r^2\times n2(r)/S\}>2/3$$

It follows that a condition that prevents the conductive region from extending is expressed as:

$$\Sigma r^2\times n1(r)/\Sigma r^2\times n2(r)>2.0 \quad (1)$$

More preferably, $$\Sigma r^2\times n1(r)/\Sigma r^2\times n2(r)>2.040 \quad (2)$$

When the above condition is satisfied, the island-like conductive region does not occur over the radius r of 105 so long as the entire fine powder has the presumed sizes of less than 0.1 μm. Among the cells positioned at the distance r of 105, the cells obliquely spaced from the center cell are remotest from the center cell; the distance r is 0.1 (μm)×105 $\times\sqrt{2}$=14.8 (μm). Because the radius is 14.8 μm, the maximum possible diameter of the island-like conductive region is 29.7 μm.

The diameter of 29.7 μm mentioned above is about 70% of a dot size for resolution of 600 dpi (dots per inch). Even when the local omission of an image is too small to be recognized by eye, dots lost by more than 70% each are present in a dither image or similar halftone image are apt to render the image granular in a macro view. Therefore, to form an image free from noticeably granularity, it is necessary to prevent the island-like conductive region from extending over 29.7 μm. Assuming that the entire fine powder has a size of 0.1 μm, which allows electrical connection to occur most easily, then the probability p must be smaller than or equal to 0.329, so that the expected value of the number of conductive cells at the radius r of 105 can be less than 1. This condition is represented by the relation (2).

Now, even the charge-promoting conductive grains with the size of 0.1 μm or above sometimes firmly adhere to the surface of the image carrier, depending on the surface condition of the image carrier. More specifically, when the fine charge-promoting conductive grains deposit on the portions of the image carrier corresponding to dents originally present or produced due to repeated operation, it is difficult to remove the grains with a frictional force. While the grain size to deposit on such dents is dependent on the depth of the dents, we found that dents as deep as about 0.6 μm were sometimes produced in the image carrier due to repeated operation. The conductive grains concentratedly deposit on such dents, tending to extend the island-like conductive region.

Particularly, when the friction of the cleaning blade and the collision of the charge-promoting conductive grains acts on the grains trapped in the dents of the image carrier, the grains in the dents are apt to form scratches in the direction of movement of the image carrier while being buried deeper into the dents. In such a case, even grains whose size is slightly larger than the depth of the dents are apt to firmly adhere to the image carrier while the other conductive grains are apt to enter the above scratches, producing conductive regions.

While the above phenomenon may be obviated if the surface of the image carrier is hardened, it is, in practice, impossible to fully smooth the surface of the image carrier. Consequently, some means for preventing the conductive regions from extending despite the dents of the image carrier is essential.

It follows that, to prevent the above conductive regions from growing, it is necessary to adjust the content of the insulative grains and that of the conductive grains parted from each other in the developer relative to each other even when the grain size is as small as 0.6 μm or below. More specifically, for the grain size of 0.6 μm or below, a developer containing n1(*r*) insulative grains of a size r and n2(*r*) conductive grains of size r, then the blur of a latent image could be obviated under the following condition:

$$\Sigma r^2\times n1(r)/\Sigma r^2\times n2(r)>2.247 \quad (3)$$

where Σ denotes summation relating to the grain size r.

The above relation (3), like the relation (2), is obtained by estimating a condition that obviates a 10.5 μm long, island-like conductive region on the assumption that the entire fine powder deposited on the image carrier has the size of 0.6 μm. More specifically, the above condition obviates electrical connection over the radius of (10.5 μm/0.6 μm) in terms of the number of cells. In this condition, the probability p was smaller than or equal to 0.308.

While the island-like conductive region grows mainly in the unidimensional direction, the condition of the illustrative embodiment that limits the growth of the island-like conductive region in all directions can, of course, limit the extension in the unidimensional direction.

The blur of a latent image is most conspicuously brought about by the deposition of the fine powder of the charge-promoting conductive grains whose grain size is two times or more as great as a mean distance between nearby injection sites. To determine a distance between nearby injection sites, as for an image carrier having a surface layer of resin in which conductive grains are dispersed, the surface of the image carrier may be photographed to thereby directly measure a distance between injected conductive grains. Alternatively, when uniform dispersion is assumed, a distance between nearby injection sites may be produced by approximation:

$$x\times(y/100)^{(1/3)}(\mu m)$$

where x denotes the mean grain size of injected conductive grains, and y denotes a volume percent representative of the ratio of the subject conductive grains to the entire surface layer.

Why the fine powder of the conductive grains whose mean-number grain size is two times or more as great as the mean distance between the subject conductive grains or injection sites aggravates the blur of a latent image is as follows. In such a condition, two or more subject conductive grains are electrically connected together with high probability and cause island-like conductive regions to join each other to form a large island-line conductive region, noticeably blurring a latent image. It follows that the blur of a latent image can be effectively reduced if the relation (1), (2)

or (3) is satisfied as to at least the grain size two times as great as the mean distance between the subject conductive grains, but 0.1 μm or less.

In the illustrative embodiment, the insulative grains are implemented as inorganic grains stated earlier. While the inorganic grains are contained in a developer for improving the fluidity of toner as well as for other purposes, it has heretofore been considered that the inorganic grains, used as an additive, should preferably be present on the surfaces of toner grains in order to serve the expected functions. By contrast, in the illustrative embodiment, part of such inorganic grains is caused to part from toner grains in order to obstruct electrical connection between the charge-promoting conductive grains on the image carrier. By so adjusting the grain size distribution of the inorganic grains, it is possible to conveniently reduce the blur of a latent image.

It is to be noted that the insulative grains used in the illustrative embodiment are not limited to the conventional inorganic grains, but may be implemented as exclusive insulative grains in the case where an additive is not added to toner grains. The crux is that the insulative grains are electrically insulative.

The grain size and grain size distribution of the charge-promoting conductive grains and those of the insulative grains may be adjusted by any one of conventional methods including one that adequately selects a method and conditions for the production of the primary grains, one that uses a material allowing the primary grains to easily cohere, one that prepares large grains and then adjusts conditions for pulverizing them, and one that selects grains of preselected size by classification. To obviate blur ascribable to the deposition of the conductive grains on the image carrier, it suffices to select, among various grain size distributions of the conductive grains and insulative grains implemented by the above various methods, grain size distributions that satisfy the relations stated earlier.

To measure the mean grain size and grain size distribution of the conductive grains and those of the insulative grains, use may be made of a grain size distribution measuring device available from Beckman Coulter by way of example. With this measuring device, it is possible to measure a grain size distribution over a range of from 0.04 μm to 2,000 μm.

Whether or not the grain size distribution of the charge-promoting conductive grains and that of the insulative grains satisfy the conditions of the illustrative embodiment may be determined by the following relatively simple method. First, there are produced a mixture of toner grains and charge-promoting conductive grains and a mixture of toner grains and insulative grains are prepared. Subsequently, a first grain size distribution of the toner and conductive grain mixture and a second grain size distribution of the toner and insulative grain mixture are compared with each other to see if the conditions of the illustrative embodiment are satisfied for the grain size of 0.1 μm or 0.6 μm or below. Why measurement is effected by fixing toner is that consideration is given to the fact that the conductive grains and insulative grains deposit on toner grains. Measurement without toner grains is not desirable because the ratio of the conductive or the insulative grains to deposit on the toner grains is not clear.

On the other hand, to make the above decision with a mixture of toner grains, charge-promoting conductive grains and insulative grains prepared beforehand, there may be compared an enlarged photograph of a developer taken by a scanning electron microscope and maps of elements contained in the conductive grains and insulative grains output from XMA associated with a scanning electron microscope or similar element analyzing means.

Although it is technically difficult to accurately measure the grain sizes of grains as small as several nanometers, the advantages of the present invention are not attainable unless the conductive grains and insulative grains each have the particular grain size distribution stated earlier at least in a measurable grain size range.

In the illustrative embodiment, when the conductive grains and insulative grains are implemented as a cohered mass, the grain size does not refer to the grain size of the primary grains, but refers to the grain size of the cohered mass.

Figure 6:
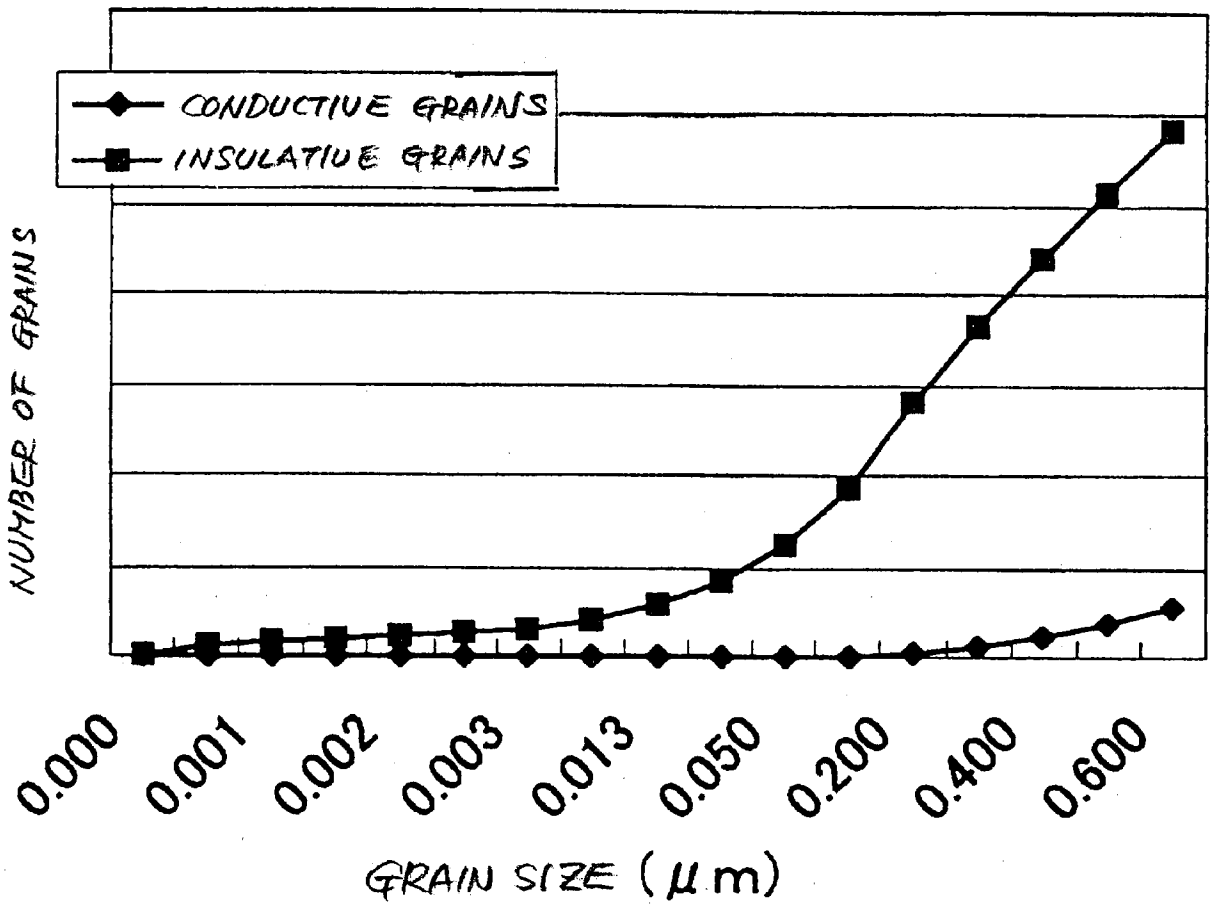
FIG. 6 is a graph showing a grain size distribution representative of grain sizes applicable to a developer of the illustrative embodiment.

As shown in FIG. 6, in the illustrative embodiment, use is made of a developer in which the amount of the conductive grains is only one-fourth or less of the amount of the insulative grains over the entire grain size distribution of less than 0.6 μm inclusive. This condition, of course, satisfies the relations (1), (2) and (3) stated earlier. When such a developer is used, even when the conductive grains fed from the developing device together with toner grains deposit on the image carrier, the insulative grains also fed from the developing device together with the toner grains deposit around the conductive grains and therefore obstruct the growth of electrical connection. Stated another way, the blur of a latent image is immediately coped with when the conductive grains deposit on the image carrier. This successfully obviates blur even when the concentrated deposition of the conductive grains occurs in the developing device.

If the insulative grains are enriched relative to the conductive grains as in the illustrative embodiment, the function described above can be preserved for a long time even in an image forming apparatus using a developer carrier that allows the conductive grains to easily deposit thereon before the insulative grains or an image forming apparatus of the type transferring the conductive grains more than the insulative grains.

In operation, a latent image formed on the drum 11 is developed by the developing unit 13 using a single-ingredient type developer, or toner, so that a toner image is formed on the drum 11. At this instant, the charge-promoting conductive grains contained in the developer move toward the drum 11 together with or by being forced by the toner grains.

The fine powder of the charge-promoting conductive grains deposited on the drum 11 forms a conductive region and contacts the subject conductive grains, which constitute the injection sites, for thereby scattering charge in the conductive region. Such deposition of the charge-promoting conductive grains on the drum 11 is more conspicuous in the illustrative embodiment that forms the AC electric field between the drum 11 and the sleeve 13*b*. This is because the charge-promoting conductive grains are caused to oscillate or move back and forth and therefore frequently hit against each other and against the drum 11 or the sleeve 13*b*. On the other hand, the collision of the charge-promoting conductive grains serves to part them from the toner grains or loosen the conductive grains, thereby providing the conductive grains with an adequate grain size. In this manner, while forming the AC electric field, the illustrative embodiment obviates the blur of a latent image ascribable to the charge-promoting conductive grains by electric disconnection effected by the insulative grains.

Because the charge-promoting conductive grains are conductive and do not easily move when subject to an electric field, they, in many cases, move toward the drum 11 by being forced by the toner grains as in the non-contact development of the illustrative embodiment. It follows that for the developing device 13 to feed a preselected amount of charge-promoting conductive grains, the conductive grains are apt to gather around an image portion more density than in the case of contact type development and blur a latent image. Also, in jumping development, toner grains are easily attracted toward the contour of a latent image due to an edge effect, the charge-promoting conductive grains are also apt to deposit on the contour of a latent image and blur the latent image. By contrast, in the illustrative embodiment, the insulative grains obstruct mutual electric connection of the conductive grains deposited on the drum 11 to thereby prevent the conductive region from growing and rendering the degradation of image quality recognizable by eye.

The sheet 5 is conveyed such that its leading edge meets the leading edge of the toner image formed on the drum 11 at the image transfer position where the drum 11 and image transferring device 2 face each other. At the image transferring position, the toner image is transferred from the drum 11 to the sheet 5 by the voltage applied to the charge blade 2*b*. At this instant, the charge-promoting conductive grains present on the drum 11 further enhance the transfer efficiency of the spherical toner grains, which originally have high transfer efficiency. Also, the conductive grains are not positively transferred to the sheet 5, but remain on the drum 11, because they are conductive. Therefore, the conductive region formed by the fine powder of the conductive grains is not transferred to the sheet 5 either. On the other hand, the insulative grains with a small grain size are firmly deposited on the drum 11 due to the van der Waals' s forces and therefore mostly remain on the drum 1. The toner image thus transferred to the sheet 5 is fixed by the fixing unit 3.

The toner or residual toner left on the drum 11 after the image transfer is conveyed to the charging device 12 and again negatively charged thereby due to friction acting between the toner and the drum 11 or the charge-promoting conductive grains. The toner grains charged to positive or opposite polarity are electrostatically held on the charging member 12*c*. However, such toner grains do not lower the charging ability because the charging member 12*c* and drum 11 remain in contact with each other via the conductive grains and because the conductive grains serve as a spacer, allowing the charging member 12*c* to move at a different speed relative to the drum 11.

The residual toner grains thus regulated in polarity by the charging device 12 are again conveyed by the drum 11 to the position where the drum 11 faces the developing device 13. At this position, the toner grains deposited on an image portion are left on the drum 11 while the toner grains deposited on a non-image portion are collected by the developing device 13. Motive power for the collection is the electric force derived from a difference in potential between the voltage applied to the developing device 13 and the non-image portion of the drum 11. More specifically, while a frictional force to act on the residual toner grains at the developing position in contact development is another motive power, the illustrative embodiment, using non-contact development, relies only on the above electric force in collecting the residual toner. Although this may make the collection of residual toner difficult, the illustrative embodiment can enhance collection efficiency despite non-contact development because the charge-promoting conductive grains play the role of a spacer.

As stated above, the illustrative embodiment achieves various unprecedented advantages, as enumerated below.

(1) There can be reduced the blur of a latent image ascribable to the deposition of the fine powder of conductive grains on an image carrier or in scratches formed in the image carrier.

(2) An additive customarily added to a developer for enhancing fluidity can be used as insulative grains. It is therefore reduces the blur of a latent image without resorting to exclusive insulative grains or even if the content of exclusive insulative grains is reduced.

(3) Conductive grains exhibit a spacer effect and reduces the blur of a latent image.

(4) Injection charging is implemented while the blur of a latent image ascribable to the deposition of the fine powder of conductive grains is reduced. This is particularly true with a cleanerless, image forming apparatus and also true with a non-contact development, image forming apparatus in which the fine powder of conductive grains are apt to concentratedly deposit on an image carrier, and an image forming apparatus of the type using a charge roller as a contact type charging member.

Various modifications will become possible for those skilled in the art after receiving the teachings of the present disclosure without departing from the scope thereof.

What is claimed is:

1. An image forming apparatus comprising a charging member and a body to be charged forming a nip therebetween at which charge-promoting conductive grains frictionally charged to a polarity opposite to a polarity of a voltage applied to said charging member are held, a developing device configured to feed toner to said body in a cleaning mode for cleaning said body, and an image transferring member configured to receive the toner fed to said body in the cleaning mode.

2. The apparatus as claimed in claim 1, wherein the image transferring member is a belt.

3. The apparatus as claimed in claim 1, further comprising a cleaning blade configured to collect the toner received by the image transferring member in the cleaning mode.

4. An image forming apparatus comprising a body to be charged, a charging member included in a charging device and having a nip formed between said body and said charging member, a developing device configured to feed toner to said body in a cleaning mode for cleaning said body, and an image transferring member configured to receive the toner fed to said body in the cleaning mode.

5. The image forming apparatus as claimed in claim 4, wherein said body comprises an amorphous silicon photoconductive element.

6. The image forming apparatus as claimed in claim 4, wherein said body comprises a surface layer hardened by a filler dispersed therein.

7. The apparatus as claimed in claim 4, wherein the image transferring member is a belt.

8. The apparatus as claimed in claim 4, further comprising a cleaning blade configured to collect the toner received by the image transferring member in the cleaning mode.

9. An image forming apparatus comprising:

a charging device comprising at least a charging member;

a body to be charged by said charging device;

a developing device configured to feed toner to said body; and an image transferring member;

wherein said charging device is operable in a cleaning mode for cleaning said body to be charged, wherein said developing device is configured to feed toner to said body to be charged in the cleaning mode for cleaning said body, and wherein the image transferring member is configured to receive the toner fed to said body in the cleaning mode.

10. The apparatus as claimed in claim 9, further comprising collecting means for collecting, in the cleaning mode, the toner fed.

11. The apparatus as claimed in claim 9, wherein the toner is produced by polymerization.

12. The apparatus as claimed in claim 9, wherein the image transferring member is a belt.

13. The apparatus as claimed in claim 9, further comprising a cleaning blade configured to collect the toner received by the image transferring member in the cleaning mode.

14. In an image forming apparatus having a process cartridge allowing a charging device and a body to be charged to be replaced integrally with each other, said charging device comprises a charging member and a member to be charged forming a nip therebetween at which charge-promoting conductive grains frictionally charged to a polarity opposite to a polarity of a voltage applied to said charging member are held, and is operable in a cleaning mode for cleaning said body to be charged, and toner is fed by a developing device to said body in the cleaning mode for cleaning said body, and said image forming apparatus comprises an image transferring member configured to receive the toner fed to said body in the cleaning mode.

15. The apparatus as claimed in claim 14, wherein the image transferring member is a belt.

16. The apparatus as claimed in claim 14, further comprising a cleaning blade configured to collect the toner received by the image transferring member in the cleaning mode.

17. In an image forming apparatus comprising an image carrier, charging means for charging said image carrier, image data writing means for forming a latent image on said charged image carrier and developing means for developing said latent image with a developer, said charging means charging said image carrier in contact with said image carrier while carrying charge-promoting conductive grains at a nip portion, said image forming apparatus is operable in a cleaning mode for feeding said developer from said developing means to said image carrier and depositing charge-promoting grains on said developer to thereby remove said charge-promoting grains from said image carrier, and said image forming apparatus comprises an image transferring member configured to receive the toner fed to said body in the cleaning mode.

18. The apparatus as claimed in claim 17, further comprising collecting means for collecting the developer on which the charge-promoting conductive grains are deposited in said cleaning mode.

19. The apparatus as claimed in claim 17, further comprising grain feeding means for feeding the charge-promoting conductive grains to said charging member.

20. The apparatus as claimed in claim 17, wherein said image carrier comprises a photoconductive element formed of amorphous silicone.

21. The apparatus as claimed in claim 17, wherein said image carrier comprises a photoconductive element having a surface layer in which a filler is dispersed.

22. The apparatus as claimed in claim 17, wherein the image transferring member is a belt.

23. The apparatus as claimed in claim 17, further comprising a cleaning blade configured to collect the toner received by the image transferring member in the cleaning mode.

24. An image forming apparatus comprising:

an image carrier;

charging means for charging said image carrier in contact with said image carrier while carrying charge-promoting conductive grains at a nip between said charging means and said image carrier;

image data writing means for forming a latent image on said image carrier charged by said charging means; and developing means for developing the latent image with a developer;

wherein said image forming apparatus is operable in a cleaning mode in which said charging means is connected to ground to cause the charge-promoting conductive grains to move to said image carrier at the nip, and the developer is fed from said developing means to said image carrier to cause said charge-promoting conductive grains to deposit on said developer, whereby said charge-promoting conductive grains are removed from said image carrier.

25. The apparatus as claimed in claim 24, further comprising collecting means for collecting the developer on which the charge-promoting conductive grains are deposited in said cleaning mode.

26. The apparatus as claimed in claim 24, further comprising grain feeding means for feeding the charge-promoting conductive grains to said charging member.

27. The apparatus as claimed in claim 24, wherein said image carrier comprises a photoconductive element formed of amorphous silicone.

28. The apparatus as claimed in claim 24, wherein said image carrier comprises a photoconductive element having a surface layer in which a filler is dispersed.

* * * * *